US008991473B2

(12) United States Patent
Bornemann et al.

(10) Patent No.: US 8,991,473 B2
(45) Date of Patent: Mar. 31, 2015

(54) METAL ALLOY INJECTION MOLDING PROTRUSIONS

(71) Applicant: Microsoft Corporation, Redmond, WA (US)

(72) Inventors: Paul C. Bornemann, North Bend, WA (US); Raj N. Master, San Jose, CA (US); Michael Joseph Lane, Bellevue, WA (US); Seah Sun Too, Sammamish, WA (US)

(73) Assignee: Microsoft Technology Holding, LLC, Redmond, WA (US)

( * ) Notice: Subject to any disclaimer, the term of this patent is extended or adjusted under 35 U.S.C. 154(b) by 0 days.

(21) Appl. No.: 14/177,018

(22) Filed: Feb. 10, 2014

(65) Prior Publication Data

US 2014/0154523 A1 Jun. 5, 2014

Related U.S. Application Data

(62) Division of application No. 13/715,133, filed on Dec. 14, 2012, now Pat. No. 8,733,423.

(30) Foreign Application Priority Data

Oct. 17, 2012 (WO) ..... PCT/CN2012/083083

(51) Int. Cl.
*B22C 9/06* (2006.01)
*B22D 17/20* (2006.01)
(Continued)

(52) U.S. Cl.
CPC . *B22C 9/06* (2013.01); *B22D 17/20* (2013.01); *B22D 17/22* (2013.01); *B22D 17/08* (2013.01); *B22D 17/14* (2013.01)
USPC ..... 164/284; 164/359; 164/303; 164/312; 164/113

(58) Field of Classification Search
CPC ..... B22C 9/06; B22C 9/08; B22D 17/22
USPC ..... 164/113, 133, 284, 303, 312, 337, 359; 425/555
See application file for complete search history.

(56) References Cited

U.S. PATENT DOCUMENTS 578,325 A 3/1897 Fleming, Andrew
3,879,586 A 4/1975 DuRocher et al.
(Continued)

FOREIGN PATENT DOCUMENTS

CN 103455149 12/2013
EP 1223722 7/2002
(Continued)

OTHER PUBLICATIONS

"Final Office Action", U.S. Appl. No. 13/595,700, Aug. 15, 2014, 6 pages.
(Continued)

*Primary Examiner* — Kevin E Yoon
(74) *Attorney, Agent, or Firm* — Jeremy Snodgrass; Judy Yee; Micky Minhas

(57) ABSTRACT

Metal alloy injection molding techniques are described. In one or more implementations, these techniques may also include adjustment of injection pressure, configuration of runners, and/or use of vacuum pressure, and so on to encourage flow of the metal alloy through a mold. Techniques are also described that utilize protrusions to counteract thermal expansion and subsequent contraction of the metal alloy upon cooling. Further, techniques are described in which a radius of edges of a feature is configured to encourage flow and reduce voids. A variety of other techniques are also described herein.

20 Claims, 12 Drawing Sheets

(51) Int. Cl.

| | |
|---|---|
| ***B22D 17/22*** | (2006.01) |
| ***B22D 17/08*** | (2006.01) |
| ***B22D 17/14*** | (2006.01) |

(56) References Cited

U.S. PATENT DOCUMENTS

| | | | |
|---|---|---|---|
| 4,046,975 | A | 9/1977 | Seeger, Jr. |
| 4,065,649 | A | 12/1977 | Carter et al. |
| 4,243,861 | A | 1/1981 | Strandwitz |
| 4,302,648 | A | 11/1981 | Sado et al. |
| 4,317,013 | A | 2/1982 | Larson |
| 4,365,130 | A | 12/1982 | Christensen |
| 4,492,829 | A | 1/1985 | Rodrique |
| 4,527,021 | A | 7/1985 | Morikawa et al. |
| 4,559,426 | A | 12/1985 | Van Zeeland et al. |
| 4,577,822 | A | 3/1986 | Wilkerson |
| 4,588,187 | A | 5/1986 | Dell |
| 4,607,147 | A | 8/1986 | Ono et al. |
| 4,651,133 | A | 3/1987 | Ganesan et al. |
| 4,735,394 | A | 4/1988 | Facco |
| 5,008,497 | A | 4/1991 | Asher |
| 5,021,638 | A | 6/1991 | Nopper et al. |
| 5,220,521 | A | 6/1993 | Kikinis |
| 5,283,559 | A | 2/1994 | Kalendra et al. |
| 5,331,443 | A | 7/1994 | Stanisci |
| 5,340,528 | A | 8/1994 | Machida et al. |
| 5,363,075 | A | 11/1994 | Fanucchi |
| 5,480,118 | A | 1/1996 | Cross |
| 5,546,271 | A | 8/1996 | Gut et al. |
| 5,548,477 | A | 8/1996 | Kumar et al. |
| 5,558,577 | A | 9/1996 | Kato |
| 5,576,981 | A | 11/1996 | Parker et al. |
| 5,618,232 | A | 4/1997 | Martin |
| 5,681,220 | A | 10/1997 | Bertram et al. |
| 5,745,376 | A | 4/1998 | Barker et al. |
| 5,748,114 | A | 5/1998 | Koehn |
| 5,781,406 | A | 7/1998 | Hunte |
| 5,807,175 | A | 9/1998 | Davis et al. |
| 5,818,361 | A | 10/1998 | Acevedo |
| 5,828,770 | A | 10/1998 | Leis et al. |
| 5,842,027 | A | 11/1998 | Oprescu et al. |
| 5,874,697 | A | 2/1999 | Selker et al. |
| 5,926,170 | A | 7/1999 | Oba |
| 5,957,191 | A | 9/1999 | Okada et al. |
| 5,971,635 | A | 10/1999 | Wise |
| 6,002,389 | A | 12/1999 | Kasser |
| 6,005,209 | A | 12/1999 | Burleson et al. |
| 6,012,714 | A | 1/2000 | Worley et al. |
| 6,040,823 | A | 3/2000 | Seffernick et al. |
| 6,042,075 | A | 3/2000 | Burch, Jr. |
| 6,044,717 | A | 4/2000 | Biegelsen et al. |
| 6,061,644 | A | 5/2000 | Leis |
| 6,112,797 | A | 9/2000 | Colson et al. |
| 6,147,859 | A | 11/2000 | Abboud |
| 6,178,443 | B1 | 1/2001 | Lin |
| 6,228,926 | B1 | 5/2001 | Golumbic |
| 6,254,105 | B1 | 7/2001 | Rinde et al. |
| 6,279,060 | B1 | 8/2001 | Luke et al. |
| 6,329,617 | B1 | 12/2001 | Burgess |
| 6,344,791 | B1 | 2/2002 | Armstrong |
| 6,380,497 | B1 | 4/2002 | Hashimoto et al. |
| 6,437,682 | B1 | 8/2002 | Vance |
| 6,506,983 | B1 | 1/2003 | Wilson et al. |
| 6,511,378 | B1 | 1/2003 | Bhatt et al. |
| 6,532,147 | B1 | 3/2003 | Christ, Jr. |
| 6,543,949 | B1 | 4/2003 | Ritchey et al. |
| 6,565,439 | B2 | 5/2003 | Shinohara et al. |
| 6,585,435 | B2 | 7/2003 | Fang |
| 6,597,347 | B1 | 7/2003 | Yasutake |
| 6,600,121 | B1 | 7/2003 | Olodort et al. |
| 6,603,408 | B1 | 8/2003 | Gaba |
| 6,608,664 | B1 | 8/2003 | Hasegawa |
| 6,617,536 | B2 | 9/2003 | Kawaguchi |
| 6,651,943 | B2 | 11/2003 | Cho et al. |
| 6,675,865 | B1 | 1/2004 | Yoshida |
| 6,685,369 | B2 | 2/2004 | Lien |
| 6,695,273 | B2 | 2/2004 | Iguchi |
| 6,704,864 | B1 | 3/2004 | Philyaw |
| 6,721,019 | B2 | 4/2004 | Kono et al. |
| 6,725,318 | B1 | 4/2004 | Sherman et al. |
| 6,774,888 | B1 | 8/2004 | Genduso |
| 6,776,546 | B2 | 8/2004 | Kraus et al. |
| 6,781,819 | B2 | 8/2004 | Yang et al. |
| 6,784,869 | B1 | 8/2004 | Clark et al. |
| 6,813,143 | B2 | 11/2004 | Mäkelä |
| 6,819,316 | B2 | 11/2004 | Schulz et al. |
| 6,819,547 | B2 | 11/2004 | Minaguchi et al. |
| 6,856,506 | B2 | 2/2005 | Doherty et al. |
| 6,861,961 | B2 | 3/2005 | Sandbach et al. |
| 6,864,573 | B2 | 3/2005 | Robertson et al. |
| 6,898,315 | B2 | 5/2005 | Guha |
| 6,914,197 | B2 | 7/2005 | Doherty et al. |
| 6,950,950 | B2 | 9/2005 | Sawyers et al. |
| 6,962,454 | B1 | 11/2005 | Costello |
| 6,970,957 | B1 | 11/2005 | Oshins et al. |
| 6,976,799 | B2 | 12/2005 | Kim et al. |
| 6,979,799 | B2 | 12/2005 | Centner |
| 7,018,678 | B2 | 3/2006 | Gronbeck et al. |
| 7,051,149 | B2 | 5/2006 | Wang et al. |
| 7,083,295 | B1 | 8/2006 | Hanna |
| 7,091,436 | B2 | 8/2006 | Serban |
| 7,106,222 | B2 | 9/2006 | Ward et al. |
| 7,123,292 | B1 | 10/2006 | Seeger et al. |
| 7,169,460 | B1 | 1/2007 | Chen et al. |
| 7,194,662 | B2 | 3/2007 | Do et al. |
| 7,201,508 | B2 | 4/2007 | Misaras |
| 7,213,991 | B2 | 5/2007 | Chapman et al. |
| 7,224,830 | B2 | 5/2007 | Nefian et al. |
| 7,277,087 | B2 | 10/2007 | Hill et al. |
| 7,301,759 | B2 | 11/2007 | Hsiung |
| 7,365,967 | B2 | 4/2008 | Zheng |
| 7,374,312 | B2 | 5/2008 | Feng et al. |
| 7,447,934 | B2 | 11/2008 | Dasari et al. |
| 7,469,386 | B2 | 12/2008 | Bear et al. |
| 7,486,165 | B2 | 2/2009 | Ligtenberg et al. |
| 7,499,037 | B2 | 3/2009 | Lube |
| 7,502,803 | B2 | 3/2009 | Culter et al. |
| 7,542,052 | B2 | 6/2009 | Solomon et al. |
| 7,558,594 | B2 | 7/2009 | Wilson |
| 7,559,834 | B1 | 7/2009 | York |
| RE40,891 | E | 9/2009 | Yasutake |
| 7,620,244 | B1 | 11/2009 | Collier |
| 7,636,921 | B2 | 12/2009 | Louie |
| 7,639,329 | B2 | 12/2009 | Takeda et al. |
| 7,639,876 | B2 | 12/2009 | Clary et al. |
| 7,656,392 | B2 | 2/2010 | Bolender |
| 7,686,066 | B2 | 3/2010 | Hirao |
| 7,722,792 | B2 | 5/2010 | Uezaki et al. |
| 7,728,923 | B2 | 6/2010 | Kim et al. |
| 7,731,147 | B2 | 6/2010 | Rha |
| 7,733,326 | B1 | 6/2010 | Adiseshan |
| 7,773,076 | B2 | 8/2010 | Pittel et al. |
| 7,773,121 | B1 | 8/2010 | Huntsberger et al. |
| 7,774,155 | B2 | 8/2010 | Sato et al. |
| 7,777,972 | B1 | 8/2010 | Chen et al. |
| 7,782,342 | B2 | 8/2010 | Koh |
| 7,813,715 | B2 | 10/2010 | McKillop et al. |
| 7,815,358 | B2 | 10/2010 | Inditsky |
| 7,817,428 | B2 | 10/2010 | Greer, Jr. et al. |
| 7,822,338 | B2 | 10/2010 | Wernersson |
| 7,865,639 | B2 | 1/2011 | McCoy et al. |
| 7,884,807 | B2 | 2/2011 | Hovden et al. |
| 7,893,921 | B2 | 2/2011 | Sato |
| 7,907,394 | B2 | 3/2011 | Richardson et al. |
| D636,397 | S | 4/2011 | Green |
| 7,928,964 | B2 | 4/2011 | Kolmykov-Zotov et al. |
| 7,932,890 | B2 | 4/2011 | Onikiri et al. |
| 7,936,501 | B2 | 5/2011 | Smith et al. |
| 7,944,520 | B2 | 5/2011 | Ichioka et al. |
| 7,945,717 | B2 | 5/2011 | Rivalsi |
| 7,970,246 | B2 | 6/2011 | Travis et al. |
| 7,973,771 | B2 | 7/2011 | Geaghan |
| 7,978,281 | B2 | 7/2011 | Vergith et al. |
| 8,016,255 | B2 | 9/2011 | Lin |

(56) References Cited

U.S. PATENT DOCUMENTS

| | | | |
|---|---|---|---|
| 8,018,386 | B2 | 9/2011 | Qi et al. |
| 8,018,579 | B1 | 9/2011 | Krah |
| 8,026,904 | B2 | 9/2011 | Westerman |
| 8,053,688 | B2 | 11/2011 | Conzola et al. |
| 8,059,384 | B2 | 11/2011 | Park et al. |
| 8,065,624 | B2 | 11/2011 | Morin et al. |
| 8,069,356 | B2 | 11/2011 | Rathi et al. |
| 8,077,160 | B2 | 12/2011 | Land et al. |
| 8,090,885 | B2 | 1/2012 | Callaghan et al. |
| 8,098,233 | B2 | 1/2012 | Hotelling et al. |
| 8,115,499 | B2 | 2/2012 | Osoinach et al. |
| 8,117,362 | B2 | 2/2012 | Rodriguez et al. |
| 8,118,274 | B2 | 2/2012 | Mcclure et al. |
| 8,120,166 | B2 | 2/2012 | Koizumi et al. |
| 8,130,203 | B2 | 3/2012 | Westerman |
| 8,154,524 | B2 | 4/2012 | Wilson et al. |
| 8,162,282 | B2 | 4/2012 | Hu et al. |
| D659,139 | S | 5/2012 | Gengler |
| 8,169,421 | B2 | 5/2012 | Wright et al. |
| 8,189,973 | B2 | 5/2012 | Travis et al. |
| 8,229,509 | B2 | 7/2012 | Paek et al. |
| 8,229,522 | B2 | 7/2012 | Kim et al. |
| 8,248,791 | B2 | 8/2012 | Wang et al. |
| 8,255,708 | B1 | 8/2012 | Zhang |
| 8,263,730 | B2 | 9/2012 | Shimizu |
| 8,267,368 | B2 | 9/2012 | Torii et al. |
| 8,274,784 | B2 | 9/2012 | Franz et al. |
| 8,279,589 | B2 | 10/2012 | Kim |
| 8,322,290 | B1 | 12/2012 | Mignano |
| 8,389,078 | B2 | 3/2013 | Lin et al. |
| 8,403,576 | B2 | 3/2013 | Merz |
| 8,416,559 | B2 | 4/2013 | Agata et al. |
| 8,498,100 | B1 | 7/2013 | Whitt, Iii et al. |
| 8,543,227 | B1 | 9/2013 | Perek et al. |
| 8,548,608 | B2 | 10/2013 | Perek et al. |
| 8,564,944 | B2 | 10/2013 | Whitt, Iii et al. |
| 8,570,725 | B2 | 10/2013 | Whitt, Iii et al. |
| 8,610,015 | B2 | 12/2013 | Whitt, Iii et al. |
| 8,614,666 | B2 | 12/2013 | Whitman et al. |
| 8,646,999 | B2 | 2/2014 | Shaw et al. |
| 8,654,030 | B1 | 2/2014 | Mercer |
| 2002/0134828 | A1 | 9/2002 | Sandbach et al. |
| 2002/0163510 | A1 | 11/2002 | Williams et al. |
| 2003/0132916 | A1 | 7/2003 | Kramer |
| 2003/0163611 | A1 | 8/2003 | Nagao |
| 2003/0173195 | A1 | 9/2003 | Federspiel |
| 2003/0197687 | A1 | 10/2003 | Shetter |
| 2004/0048941 | A1 | 3/2004 | Raffel et al. |
| 2004/0100457 | A1 | 5/2004 | Mandle |
| 2004/0258924 | A1 | 12/2004 | Berger et al. |
| 2004/0268000 | A1 | 12/2004 | Barker et al. |
| 2005/0030728 | A1 | 2/2005 | Kawashima et al. |
| 2005/0057515 | A1 | 3/2005 | Bathiche |
| 2005/0059489 | A1 | 3/2005 | Kim |
| 2005/0134717 | A1 | 6/2005 | Misawa |
| 2005/0146512 | A1 | 7/2005 | Hill et al. |
| 2005/0240949 | A1 | 10/2005 | Liu et al. |
| 2005/0264653 | A1 | 12/2005 | Starkweather et al. |
| 2005/0264988 | A1 | 12/2005 | Nicolosi |
| 2005/0285703 | A1 | 12/2005 | Wheeler et al. |
| 2006/0049993 | A1 | 3/2006 | Lin et al. |
| 2006/0082973 | A1 | 4/2006 | Egbert et al. |
| 2006/0085658 | A1 | 4/2006 | Allen et al. |
| 2006/0102914 | A1 | 5/2006 | Smits et al. |
| 2006/0125799 | A1 | 6/2006 | Hillis et al. |
| 2006/0132423 | A1 | 6/2006 | Travis |
| 2006/0154725 | A1 | 7/2006 | Glaser et al. |
| 2006/0156415 | A1 | 7/2006 | Rubinstein et al. |
| 2006/0181514 | A1 | 8/2006 | Newman |
| 2006/0187216 | A1 | 8/2006 | Trent et al. |
| 2006/0195522 | A1 | 8/2006 | Miyazaki |
| 2006/0197755 | A1 | 9/2006 | Bawany |
| 2006/0238510 | A1 | 10/2006 | Panotopoulos et al. |
| 2006/0254042 | A1 | 11/2006 | Chou et al. |
| 2007/0047221 | A1 | 3/2007 | Park |
| 2007/0056385 | A1 | 3/2007 | Lorenz |
| 2007/0062089 | A1 | 3/2007 | Homer et al. |
| 2007/0069153 | A1 | 3/2007 | Pai-Paranjape et al. |
| 2007/0072474 | A1 | 3/2007 | Beasley et al. |
| 2007/0116929 | A1 | 5/2007 | Fujimori et al. |
| 2007/0145945 | A1 | 6/2007 | McGinley et al. |
| 2007/0182663 | A1 | 8/2007 | Biech |
| 2007/0182722 | A1 | 8/2007 | Hotelling et al. |
| 2007/0188478 | A1 | 8/2007 | Silverstein et al. |
| 2007/0200830 | A1 | 8/2007 | Yamamoto |
| 2007/0220708 | A1 | 9/2007 | Lewis |
| 2007/0234420 | A1 | 10/2007 | Novotney et al. |
| 2007/0236408 | A1 | 10/2007 | Yamaguchi et al. |
| 2007/0236475 | A1 | 10/2007 | Wherry |
| 2007/0247338 | A1 | 10/2007 | Marchetto |
| 2007/0247432 | A1 | 10/2007 | Oakley |
| 2007/0260892 | A1 | 11/2007 | Paul et al. |
| 2007/0274094 | A1 | 11/2007 | Schultz et al. |
| 2007/0274095 | A1 | 11/2007 | Destain |
| 2007/0283179 | A1 | 12/2007 | Burnett et al. |
| 2008/0005423 | A1 | 1/2008 | Jacobs et al. |
| 2008/0013809 | A1 | 1/2008 | Zhu et al. |
| 2008/0030937 | A1 | 2/2008 | Russo et al. |
| 2008/0104437 | A1 | 5/2008 | Lee |
| 2008/0151478 | A1 | 6/2008 | Chern |
| 2008/0158185 | A1 | 7/2008 | Westerman |
| 2008/0167832 | A1 | 7/2008 | Soss |
| 2008/0174570 | A1 | 7/2008 | Jobs et al. |
| 2008/0180411 | A1 | 7/2008 | Solomon et al. |
| 2008/0219025 | A1 | 9/2008 | Spitzer et al. |
| 2008/0228969 | A1 | 9/2008 | Cheah et al. |
| 2008/0232061 | A1 | 9/2008 | Wang et al. |
| 2008/0238884 | A1 | 10/2008 | Harish |
| 2008/0253822 | A1 | 10/2008 | Matias |
| 2008/0309636 | A1 | 12/2008 | Feng et al. |
| 2008/0316002 | A1 | 12/2008 | Brunet et al. |
| 2008/0320190 | A1 | 12/2008 | Lydon et al. |
| 2009/0007001 | A1 | 1/2009 | Morin et al. |
| 2009/0009476 | A1 | 1/2009 | Daley, III |
| 2009/0073060 | A1 | 3/2009 | Shimasaki et al. |
| 2009/0073957 | A1 | 3/2009 | Newland et al. |
| 2009/0079639 | A1 | 3/2009 | Hotta et al. |
| 2009/0083562 | A1 | 3/2009 | Park et al. |
| 2009/0096756 | A1 | 4/2009 | Lube |
| 2009/0127005 | A1 | 5/2009 | Zachut et al. |
| 2009/0140985 | A1 | 6/2009 | Liu |
| 2009/0163147 | A1 | 6/2009 | Steigerwald et al. |
| 2009/0167728 | A1 | 7/2009 | Geaghan et al. |
| 2009/0174687 | A1 | 7/2009 | Ciesla et al. |
| 2009/0189873 | A1 | 7/2009 | Peterson et al. |
| 2009/0195497 | A1 | 8/2009 | Fitzgerald et al. |
| 2009/0231275 | A1 | 9/2009 | Odgers |
| 2009/0251008 | A1 | 10/2009 | Sugaya |
| 2009/0259865 | A1 | 10/2009 | Sheynblat et al. |
| 2009/0262492 | A1 | 10/2009 | Whitchurch et al. |
| 2009/0265670 | A1 | 10/2009 | Kim et al. |
| 2009/0303137 | A1 | 12/2009 | Kusaka et al. |
| 2009/0303204 | A1 | 12/2009 | Nasiri et al. |
| 2009/0320244 | A1 | 12/2009 | Lin |
| 2009/0321490 | A1 | 12/2009 | Groene et al. |
| 2010/0001963 | A1 | 1/2010 | Doray et al. |
| 2010/0013319 | A1 | 1/2010 | Kamiyama et al. |
| 2010/0026656 | A1 | 2/2010 | Hotelling et al. |
| 2010/0038821 | A1 | 2/2010 | Jenkins et al. |
| 2010/0045540 | A1 | 2/2010 | Lai et al. |
| 2010/0045609 | A1 | 2/2010 | Do et al. |
| 2010/0045633 | A1 | 2/2010 | Gettemy et al. |
| 2010/0051356 | A1 | 3/2010 | Stern et al. |
| 2010/0051432 | A1 | 3/2010 | Lin et al. |
| 2010/0053534 | A1 | 3/2010 | Hsieh et al. |
| 2010/0077237 | A1 | 3/2010 | Sawyers |
| 2010/0081377 | A1 | 4/2010 | Chatterjee et al. |
| 2010/0085321 | A1 | 4/2010 | Pundsack |
| 2010/0102182 | A1 | 4/2010 | Lin |
| 2010/0103112 | A1 | 4/2010 | Yoo et al. |
| 2010/0123686 | A1 | 5/2010 | Klinghult et al. |
| 2010/0133398 | A1 | 6/2010 | Chiu et al. |
| 2010/0142130 | A1 | 6/2010 | Wang et al. |
| 2010/0149111 | A1 | 6/2010 | Olien |

(56) References Cited

U.S. PATENT DOCUMENTS

2010/0149134 A1 6/2010 Westerman et al.
2010/0149377 A1 6/2010 Shintani et al.
2010/0156798 A1 6/2010 Archer
2010/0161522 A1 6/2010 Tirpak et al.
2010/0164857 A1 7/2010 Liu et al.
2010/0171891 A1 7/2010 Kaji et al.
2010/0174421 A1 7/2010 Tsai et al.
2010/0180063 A1 7/2010 Ananny et al.
2010/0188299 A1 7/2010 Rinehart et al.
2010/0188338 A1 7/2010 Longe
2010/0206614 A1 8/2010 Park et al.
2010/0206644 A1 8/2010 Yeh
2010/0214214 A1 8/2010 Corson et al.
2010/0214257 A1 8/2010 Wussler et al.
2010/0222110 A1 9/2010 Kim et al.
2010/0231498 A1 9/2010 Large et al.
2010/0231510 A1 9/2010 Sampsell et al.
2010/0231556 A1 9/2010 Mines et al.
2010/0238075 A1 9/2010 Pourseyed
2010/0238138 A1 9/2010 Goertz et al.
2010/0245221 A1 9/2010 Khan
2010/0250988 A1 9/2010 Okuda et al.
2010/0274932 A1 10/2010 Kose
2010/0279768 A1 11/2010 Huang et al.
2010/0289457 A1 11/2010 Onnerud et al.
2010/0291331 A1 11/2010 Schaefer
2010/0295812 A1 11/2010 Burns et al.
2010/0302378 A1 12/2010 Marks et al.
2010/0304793 A1 12/2010 Kim et al.
2010/0306538 A1 12/2010 Thomas et al.
2010/0308778 A1 12/2010 Yamazaki et al.
2010/0308844 A1 12/2010 Day et al.
2010/0315348 A1 12/2010 Jellicoe et al.
2010/0321339 A1 12/2010 Kimmel
2010/0325155 A1 12/2010 Skinner et al.
2010/0331059 A1 12/2010 Apgar et al.
2011/0012873 A1 1/2011 Prest et al.
2011/0019123 A1 1/2011 Prest et al.
2011/0031287 A1 2/2011 Le Gette et al.
2011/0036965 A1 2/2011 Zhang et al.
2011/0037721 A1 2/2011 Cranfill et al.
2011/0043990 A1 2/2011 Mickey et al.
2011/0055407 A1 3/2011 Lydon et al.
2011/0060926 A1 3/2011 Brooks et al.
2011/0069148 A1 3/2011 Jones et al.
2011/0074688 A1 3/2011 Hull et al.
2011/0102356 A1 5/2011 Kemppinen et al.
2011/0115747 A1 5/2011 Powell et al.
2011/0134032 A1 6/2011 Chiu et al.
2011/0134112 A1 6/2011 Koh et al.
2011/0157087 A1 6/2011 Kanehira et al.
2011/0163955 A1 7/2011 Nasiri et al.
2011/0164370 A1 7/2011 Mcclure et al.
2011/0167181 A1 7/2011 Minoo et al.
2011/0167287 A1 7/2011 Walsh et al.
2011/0167391 A1 7/2011 Momeyer et al.
2011/0167992 A1 7/2011 Eventoff et al.
2011/0179864 A1 7/2011 Raasch et al.
2011/0183120 A1 7/2011 Sharygin et al.
2011/0184646 A1 7/2011 Wong et al.
2011/0193787 A1 8/2011 Morishige et al.
2011/0193938 A1 8/2011 Oderwald et al.
2011/0202878 A1 8/2011 Park et al.
2011/0205372 A1 8/2011 Miramontes
2011/0216266 A1 9/2011 Travis
2011/0227913 A1 9/2011 Hyndman
2011/0231682 A1 9/2011 Kakish et al.
2011/0234502 A1 9/2011 Yun et al.
2011/0242138 A1 10/2011 Tribble
2011/0248152 A1 10/2011 Svajda et al.
2011/0248920 A1 10/2011 Larsen
2011/0248941 A1 10/2011 Abdo et al.
2011/0261001 A1 10/2011 Liu
2011/0261083 A1 10/2011 Wilson
2011/0266672 A1 11/2011 Sylvester
2011/0267272 A1 11/2011 Meyer et al.
2011/0290686 A1 12/2011 Huang
2011/0295697 A1 12/2011 Boston et al.
2011/0297566 A1 12/2011 Gallagher et al.
2011/0304577 A1 12/2011 Brown et al.
2011/0305875 A1 12/2011 Sanford et al.
2011/0316807 A1 12/2011 Corrion
2012/0007821 A1 1/2012 Zaliva
2012/0011462 A1 1/2012 Westerman et al.
2012/0013519 A1 1/2012 Hakansson et al.
2012/0023459 A1 1/2012 Westerman
2012/0024682 A1 2/2012 Huang et al.
2012/0026048 A1 2/2012 Vazquez et al.
2012/0032887 A1 2/2012 Chiu et al.
2012/0044179 A1 2/2012 Hudson
2012/0047368 A1 2/2012 Chinn et al.
2012/0050975 A1 3/2012 Garelli et al.
2012/0068919 A1 3/2012 Lauder et al.
2012/0075249 A1 3/2012 Hoch
2012/0081316 A1 4/2012 Sirpal et al.
2012/0087078 A1 4/2012 Medica et al.
2012/0092279 A1 4/2012 Martin
2012/0094257 A1 4/2012 Pillischer et al.
2012/0099749 A1 4/2012 Rubin et al.
2012/0106082 A1 5/2012 Wu et al.
2012/0113579 A1 5/2012 Agata et al.
2012/0115553 A1 5/2012 Mahe et al.
2012/0117409 A1 5/2012 Lee et al.
2012/0126445 A1 5/2012 Rasmussen et al.
2012/0127118 A1 5/2012 Nolting et al.
2012/0133561 A1 5/2012 Konanur et al.
2012/0140396 A1 6/2012 Zeliff et al.
2012/0145525 A1 6/2012 Ishikawa
2012/0155015 A1 6/2012 Govindasamy et al.
2012/0162693 A1 6/2012 Ito
2012/0175487 A1 7/2012 Goto
2012/0182242 A1 7/2012 Lindahl et al.
2012/0194393 A1 8/2012 Uttermann et al.
2012/0194448 A1 8/2012 Rothkopf
2012/0200802 A1 8/2012 Large
2012/0206937 A1 8/2012 Travis et al.
2012/0223866 A1 9/2012 Ayala Vazquez et al.
2012/0224073 A1 9/2012 Miyahara
2012/0246377 A1 9/2012 Bhesania et al.
2012/0256959 A1 10/2012 Ye et al.
2012/0274811 A1 11/2012 Bakin
2012/0300275 A1 11/2012 Vilardell et al.
2012/0312955 A1 12/2012 Randolph
2013/0009413 A1 1/2013 Chiu, Jr. et al.
2013/0063873 A1 3/2013 Wodrich et al.
2013/0088431 A1 4/2013 Ballagas et al.
2013/0106766 A1 5/2013 Yilmaz et al.
2013/0207937 A1 8/2013 Lutian et al.
2013/0227836 A1 9/2013 Whitt, Iii et al.
2013/0228023 A1 9/2013 Drasnin et al.
2013/0228433 A1 9/2013 Shaw et al.
2013/0228434 A1 9/2013 Whitt, Iii et al.
2013/0228435 A1 9/2013 Whitt, Iii et al.
2013/0228439 A1 9/2013 Whitt, Iii et al.
2013/0229100 A1 9/2013 Siddiqui et al.
2013/0229335 A1 9/2013 Whitman et al.
2013/0229347 A1 9/2013 Lutz, Iii et al.
2013/0229350 A1 9/2013 Shaw et al.
2013/0229351 A1 9/2013 Whitt, Iii et al.
2013/0229354 A1 9/2013 Whitt, Iii et al.
2013/0229356 A1 9/2013 Marwah et al.
2013/0229363 A1 9/2013 Whitman et al.
2013/0229366 A1 9/2013 Dighde et al.
2013/0229380 A1 9/2013 Lutz, III et al.
2013/0229386 A1 9/2013 Bathiche et al.
2013/0229534 A1 9/2013 Panay et al.
2013/0229568 A1 9/2013 Belesiu et al.
2013/0229570 A1 9/2013 Beck et al.
2013/0229756 A1 9/2013 Whitt, Iii et al.
2013/0229757 A1 9/2013 Whitt, Iii et al.
2013/0229758 A1 9/2013 Belesiu et al.
2013/0229759 A1 9/2013 Whitt, Iii et al.
2013/0229760 A1 9/2013 Whitt, Iii et al.
2013/0229761 A1 9/2013 Shaw et al.

(56) References Cited

U.S. PATENT DOCUMENTS

| | | | |
|---|---|---|---|
| 2013/0229762 | A1 | 9/2013 | Whitt, Iii et al. |
| 2013/0229773 | A1 | 9/2013 | Siddiqui et al. |
| 2013/0230346 | A1 | 9/2013 | Shaw et al. |
| 2013/0231755 | A1 | 9/2013 | Perek et al. |
| 2013/0232280 | A1 | 9/2013 | Perek et al. |
| 2013/0232348 | A1 | 9/2013 | Oler et al. |
| 2013/0232349 | A1 | 9/2013 | Oler et al. |
| 2013/0232353 | A1 | 9/2013 | Belesiu et al. |
| 2013/0232571 | A1 | 9/2013 | Belesiu et al. |
| 2013/0241860 | A1 | 9/2013 | Ciesla et al. |
| 2013/0300590 | A1 | 11/2013 | Dietz et al. |
| 2013/0300647 | A1 | 11/2013 | Drasnin |
| 2013/0301199 | A1 | 11/2013 | Whitt, Iii et al. |
| 2013/0301206 | A1 | 11/2013 | Whitt, Iii et al. |
| 2013/0304941 | A1 | 11/2013 | Drasnin |
| 2013/0322000 | A1 | 12/2013 | Whitt, Iii et al. |
| 2013/0322001 | A1 | 12/2013 | Whitt, Iii et al. |
| 2013/0332628 | A1 | 12/2013 | Panay et al. |
| 2013/0335330 | A1 | 12/2013 | Lane et al. |
| 2013/0335902 | A1 | 12/2013 | Campbell et al. |
| 2013/0335903 | A1 | 12/2013 | Raken et al. |
| 2013/0342465 | A1 | 12/2013 | Bathiche et al. |
| 2013/0346636 | A1 | 12/2013 | Bathiche et al. |
| 2014/0012401 | A1 | 1/2014 | Perek et al. |
| 2014/0131000 | A1 | 5/2014 | Bornemann et al. |
| 2014/0135060 | A1 | 5/2014 | Mercer |
| 2014/0148938 | A1 | 5/2014 | Zhang et al. |
| 2014/0166227 | A1 | 6/2014 | Bornemann et al. |
| 2014/0248506 | A1 | 9/2014 | Mccormack et al. |

FOREIGN PATENT DOCUMENTS

| | | | | |
|---|---|---|---|---|
| EP | 1591891 | | | 11/2005 |
| EP | 2353978 | | | 8/2011 |
| EP | 2378607 | | | 10/2011 |
| GB | 1100331 | A | * | 1/1968 |
| GB | 2123213 | | | 1/1984 |
| GB | 2178570 | | | 2/1987 |
| JP | 56108127 | | | 8/1981 |
| JP | 56159134 | A | * | 12/1981 |
| JP | 10326124 | | | 12/1998 |
| JP | 1173239 | | | 3/1999 |
| JP | 2006294361 | | | 10/2006 |
| KR | 20060003093 | | | 1/2006 |
| KR | 102011008717 | | | 8/2011 |
| NL | 1038411 | | | 5/2012 |
| WO | WO 9108915 | | | 6/1991 |
| WO | WO 03106134 | | | 12/2003 |
| WO | WO 2005027696 | | | 3/2005 |
| WO | WO 2006044818 | | | 4/2006 |
| WO | WO 2008055039 | | | 5/2008 |
| WO | WO 2010011983 | | | 1/2010 |
| WO | WO 2010105272 | | | 9/2010 |
| WO | WO-2011049609 | | | 4/2011 |
| WO | WO 2013012699 | | | 1/2013 |
| WO | WO 2013033067 | | | 3/2013 |

OTHER PUBLICATIONS

"Final Office Action", U.S. Appl. No. 13/595,700, Oct. 9, 2014, 8 pages.
"Final Office Action", U.S. Appl. No. 13/599,635, Aug. 8, 2014, 16 pages.
"Non-Final Office Action", U.S. Appl. No. 13/471,282, Sep. 3, 2014, 13 pages.
"Non-Final Office Action", U.S. Appl. No. 13/715,229, Aug. 19, 2014, 9 pages.
"Restriction Requirement", U.S. Appl. No. 13/653,184, Sep. 5, 2014, 6 pages.
"International Search Report and Written Opinion", Application No. PCT/US2013/041017, Jul. 17, 2014, 10 pages.
"International Search Report and Written Opinion", Application No. PCT/US2013/028768, Jun. 24, 2014, 12 pages.
"Non-Final Office Action", U.S. Appl. No. 13/595,700, Jun. 18, 2014, 8 pages.
"Non-Final Office Action", U.S. Appl. No. 13/599,763, May 28, 2014, 6 pages.
"Restriction Requirement", U.S. Appl. No. 13/595,700, May 28, 2014, 6 pages.
"Accessing Device Sensors", retrieved from <https://developer.palm.com/content/api/dev-guide/pdk/accessing-device-sensors.html> on May 25, 2012, 2011, 4 pages.
"ACPI Docking for Windows Operating Systems", Retrieved from: <http://www.scritube.com/limba/engleza/software/ACPI-Docking-for-Windows-Opera331824193.php> on Jul. 6, 2012, 2012, 10 pages.
"Advanced Configuration and Power Management Specification", Intel Corporation, Microsoft Corporation, Toshiba Corp. Revision 1, Dec. 22, 1996, 364 pages.
"Cholesteric Liquid Crystal", Retrieved from: <http://en.wikipedia.org/wiki/Cholesteric_liquid_crystal> on Aug. 6, 2012, Jun. 10, 2012, 2 pages.
"Cirago Slim Case®—Protective case with built-in kickstand for your iPhone 5®", Retrieved from <http://cirago.com/wordpress/wpcontent/uploads/2012/10/ipc1500brochure1.pdf> on Jan. 29, 2013, Jan. 2013, 1 page.
"Corrected Notice of Allowance", U.S. Appl. No. 13/470,633, Apr. 9, 2013, 2 pages.
"Corrected Notice of Allowance", U.S. Appl. No. 13/470,633, Jul. 2, 2013, 2 pages.
"Corrected Notice of Allowance", U.S. Appl. No. 13/563,435, Jan. 14, 2014, 2 pages.
"Corrected Notice of Allowance", U.S. Appl. No. 13/563,435, Jan. 22, 2014, 2 pages.
"Corrected Notice of Allowance", U.S. Appl. No. 13/651,327, Sep. 12, 2013, 2 pages.
"Corrected Notice of Allowance", U.S. Appl. No. 13/651,327, Sep. 23, 2013, 2 pages.
"Corrected Notice of Allowance", U.S. Appl. No. 13/651,726, Sep. 17, 2013, 2 pages.
"Corrected Notice of Allowance", U.S. Appl. No. 13/656,520, Jan. 16, 2014, 3 pages.
"Corrected Notice of Allowance", U.S. Appl. No. 13/715,133, Apr. 2, 2014, 2 pages.
"Developing Next-Generation Human Interfaces using Capacitive and Infrared Proximity Sensing", Silicon Laboratories, Inc., Available at <http://www.silabs.com/pages/DownloadDoc.aspx?FILEURL=support%20documents/technicaldocs/capacitive%20and%20proximity%20sensing_wp.pdf&src=SearchResults>,Aug. 30, 2010, pp. 1-10.
"Directional Backlighting for Display Panels", U.S. Appl. No. 13/021,448, Feb. 4, 2011, 38 pages.
"DR2PA", retrieved from <http://www.architainment.co.uk/wpcontent/uploads/2012/08/DR2PA-AU-US-size-Data-Sheet-Rev-H_LOGO.pdf> on Sep. 17, 2012, Jan. 2012, 4 pages.
"Final Office Action", U.S. Appl. No. 13/471,001, Jul. 25, 2013, 20 pages.
"Final Office Action", U.S. Appl. No. 13/471,139, Sep. 16, 2013, 13 pages.
"Final Office Action", U.S. Appl. No. 13/471,336, Aug. 28, 2013, 18 pages.
"Final Office Action", U.S. Appl. No. 13/564,520, Jan. 15, 2014, 7 pages.
"Final Office Action", U.S. Appl. No. 13/651,195, Apr. 18, 2013, 13 pages.
"Final Office Action", U.S. Appl. No. 13/651,232, May 21, 2013, 21 pages.
"Final Office Action", U.S. Appl. No. 13/651,287, May 03, 2013, 16 pages.
"Final Office Action", U.S. Appl. No. 13/651,976, Jul. 25, 2013, 21 pages.
"Final Office Action", U.S. Appl. No. 13/653,321, Aug. 2, 2013, 17 pages.
"Final Office Action", U.S. Appl. No. 13/653,682, Oct. 18, 2013, 16 pages.

(56) References Cited

OTHER PUBLICATIONS

"Final Office Action", U.S. Appl. No. 13/656,055, Oct. 23, 2013, 14 pages.
"Final Office Action", U.S. Appl. No. 13/938,930, Nov. 8, 2013, 10 pages.
"Final Office Action", U.S. Appl. No. 13/939,002, Nov. 8, 2013, 7 pages.
"Final Office Action", U.S. Appl. No. 13/939,032, Dec. 20, 2013, 5 pages.
"FingerWorks Installation and Operation Guide for the TouchStream ST and TouchStream LP", FingerWorks, Inc. Retrieved from <http://ec1.imagesamazon.com/media/i3d/01/a/man-migrate/MANUAL000049862.pdf>, 2002, 14 pages.
"First One Handed Fabric Keyboard with Bluetooth Wireless Technology", Retrieved from: <http://press.xtvworld.com/article3817.html> on May 8, 2012, Jan. 6, 2005, 2 pages.
"Force and Position Sensing Resistors: An Emerging Technology", Interlink Electronics, Available at <http://staff.science.uva.nl/~vlaander/docu/FSR/An_Exploring_Technology.pdf>,Feb. 1990, pp. 1-6.
"Foreign Office Action", CN Application No. 201320097066.8, Oct. 24, 2013, 5 Pages.
"Frogpad Introduces Weareable Fabric Keyboard with Bluetooth Technology", Retrieved from: <http://www.geekzone.co.nz/content.asp?contentid=3898> on May 7, 2012, Jan. 7, 2005, 3 pages.
"How to Use the iPad's Onscreen Keyboard", Retrieved from <http://www.dummies.com/how-to/content/how-to-use-the-ipads-onscreen-keyboard.html> on Aug. 28, 2012, 2012, 3 pages.
"i-Interactor electronic pen", Retrieved from: <http://www.alibaba.com/product-gs/331004878/i_Interactor_electronic_pen.html> on Jun. 19, 2012, 2012, 5 pages.
"Incipio LG G-Slate Premium Kickstand Case—Black Nylon", Retrieved from: <http://www.amazon.com/Incipio-G-Slate-Premium-Kickstand-Case/dp/B004ZKP916> on May 8, 2012, 2012, 4 pages.
"International Search Report and Written Opinion", Application No. PCT/US2013/065154, Feb. 5, 2014, 10 pages.
"International Search Report and Written Opinion", Application No. PCT/US2013/028948, Jun. 21, 2013, 11 pages.
"International Search Report and Written Opinion", Application No. PCT/US2013/029461, Jun. 21, 2013, 11 pages.
"International Search Report and Written Opinion", Application No. PCT/US2013/044871, Aug. 14, 2013, 12 pages.
"International Search Report and Written Opinion", Application No. PCT/US2013/040968, Sep. 5, 2013, 12 pages.
"International Search Report and Written Opinion", Application No. PCT/US2013/042550, Sep. 24, 2013, 14 pages.
"International Search Report and Written Opinion", Application No. PCT/US2013/044873, Nov. 22, 2013, 9 pages.
"International Search Report and Written Opinion", Application No. PCT/US2013/045049, Sep. 16, 2013, 9 pages.
"Membrane Keyboards & Membrane Keypads", Retrieved from: <http://www.pannam.com/> on May 9, 2012, Mar. 4, 2009, 2 pages.
"Motion Sensors", Android Developers—retrieved from <http://developer.android.com/guide/topics/sensors/sensors_motion.html> on May 25, 2012, 2012, 7 pages.
"MPC Fly Music Production Controller", AKAI Professional, Retrieved from: <http://www.akaiprompc.com/mpc-fly> on Jul. 9, 2012, 4 pages.
"NI Releases New Maschine & Maschine Mikro", Retrieved from <http://www.djbooth.net/index/dj-equipment/entry/ni-releases-new-maschine-mikro/> on Sep. 17, 2012, 19 pages.
"Non-Final Office Action", U.S. Appl. No. 13/599,635, Feb. 25, 2014, 13 pages.
"Non-Final Office Action", U.S. Appl. No. 13/021,448, Dec. 13, 2012, 9 pages.
"Non-Final Office Action", U.S. Appl. No. 13/371,725, Nov. 7, 2013, 19 pages.
"Non-Final Office Action", U.S. Appl. No. 13/468,918, Dec. 26, 2013, 18 pages.
"Non-Final Office Action", U.S. Appl. No. 13/471,001, Feb. 19, 2013, 15 pages.
"Non-Final Office Action", U.S. Appl. No. 13/471,139, Mar. 21, 2013, 12 pages.
"Non-Final Office Action", U.S. Appl. No. 13/471,202, Feb. 11, 2013, 10 pages.
"Non-Final Office Action", U.S. Appl. No. 13/471,336, Jan. 18, 2013, 14 pages.
"Non-Final Office Action", U.S. Appl. No. 13/527,263, Jul. 19, 2013, 5 pages.
"Non-Final Office Action", U.S. Appl. No. 13/563,435, Jun. 14, 2013, 6 pages.
"Non-Final Office Action", U.S. Appl. No. 13/564,520, Jun. 19, 2013, 8 pages.
"Non-Final Office Action", U.S. Appl. No. 13/565,124, Jun. 17, 2013, 5 pages.
"Non-Final Office Action", U.S. Appl. No. 13/603,918, Dec. 19, 2013, 12 pages.
"Non-Final Office Action", U.S. Appl. No. 13/651,195, Jan. 2, 2013, 14 pages.
"Non-Final Office Action", U.S. Appl. No. 13/651,232, Jan. 17, 2013, 15 pages.
"Non-Final Office Action", U.S. Appl. No. 13/651,232, Dec. 5, 2013, 15 pages.
"Non-Final Office Action", U.S. Appl. No. 13/651,272, Feb. 12, 2013, 10 pages.
"Non-Final Office Action", U.S. Appl. No. 13/651,287, Jan. 29, 2013, 13 pages.
"Non-Final Office Action", U.S. Appl. No. 13/651,304, Mar. 22, 2013, 9 pages.
"Non-Final Office Action", U.S. Appl. No. 13/651,327, Mar. 22, 2013, 6 pages.
"Non-Final Office Action", U.S. Appl. No. 13/651,726, Apr. 15, 2013, 6 pages.
"Non-Final Office Action", U.S. Appl. No. 13/651,871, Mar. 18, 2013, 14 pages.
"Non-Final Office Action", U.S. Appl. No. 13/651,871, Jul. 1, 2013, 5 pages.
"Non-Final Office Action", U.S. Appl. No. 13/651,976, Feb. 22, 2013, 16 pages.
"Non-Final Office Action", U.S. Appl. No. 13/653,321, Feb. 1, 2013, 13 pages.
"Non-Final Office Action", U.S. Appl. No. 13/653,682, Feb. 7, 2013, 11 pages.
"Non-Final Office Action", U.S. Appl. No. 13/653,682, Jun. 3, 2013, 14 pages.
"Non-Final Office Action", U.S. Appl. No. 13/656,055, Apr. 23, 2013, 11 pages.
"Non-Final Office Action", U.S. Appl. No. 13/656,520, Feb. 1, 2013, 15 pages.
"Non-Final Office Action", U.S. Appl. No. 13/656,520, Jun. 5, 2013, 8 pages.
"Non-Final Office Action", U.S. Appl. No. 13/780,228, Oct. 30, 2013, 12 pages.
"Non-Final Office Action", U.S. Appl. No. 13/938,930, Aug. 29, 2013, 9 pages.
"Non-Final Office Action", U.S. Appl. No. 13/939,002, Aug. 28, 2013, 6 pages.
"Non-Final Office Action", U.S. Appl. No. 13/939,002, Dec. 20, 2013, 5 pages.
"Non-Final Office Action", U.S. Appl. No. 13/939,032, Aug. 29, 2013, 7 pages.
"Non-Final Office Action", U.S. Appl. No. 14/063,912, Jan. 2, 2014, 10 pages.
"Notice of Allowance", U.S. Appl. No. 13/470,633, Mar. 22, 2013, 7 pages.
"Notice of Allowance", U.S. Appl. No. 13/471,202, May 28, 2013, 7 pages.
"Notice of Allowance", U.S. Appl. No. 13/563,435, Nov. 12, 2013, 5 pages.
"Notice of Allowance", U.S. Appl. No. 13/565,124, Dec. 24, 2013, 6 pages.

(56) References Cited

OTHER PUBLICATIONS

"Notice of Allowance", U.S. Appl. No. 13/651,195, Jul. 8, 2013, 9 pages.
"Notice of Allowance", U.S. Appl. No. 13/651,272, May 2, 2013, 7 pages.
"Notice of Allowance", U.S. Appl. No. 13/651,304, Jul. 1, 2013, 5 pages.
"Notice of Allowance", U.S. Appl. No. 13/651,327, Jun. 11, 2013, 7 pages.
"Notice of Allowance", U.S. Appl. No. 13/651,726, May 31, 2013, 5 pages.
"Notice of Allowance", U.S. Appl. No. 13/651,871, Oct. 2, 2013, 7 pages.
"Notice of Allowance", U.S. Appl. No. 13/653,321, Dec. 18, 2013, 4 pages.
"Notice of Allowance", U.S. Appl. No. 13/656,520, Oct. 2, 2013, 5 pages.
"Notice of Allowance", U.S. Appl. No. 13/715,133, Jan. 6, 2014, 7 pages.
"Notice to Grant", CN Application No. 201320097089.9, Sep. 29, 2013, 2 Pages.
"Notice to Grant", CN Application No. 201320097124.7, Oct. 8, 2013, 2 pages.
"On-Screen Keyboard for Windows 7, Vista, XP with Touchscreen", Retrieved from <www.comfort-software.com/on-screen-keyboard.html> on Aug. 28, 2012, Feb. 2, 2011, 3 pages.
"Optical Sensors in Smart Mobile Devices", ON Semiconductor, TND415/D, Available at <http://www.onsemi.jp/pub_link/Collateral/TND415-D.PDF>,Nov. 2010, pp. 1-13.
"Optics for Displays: Waveguide-based Wedge Creates Collimated Display Backlight", OptoIQ, retrieved from <http://www.optoiq.com/index/photonics-technologies-applications/lfw-display/lfw-article-display.articles.laser-focus-world.volume-46.issue-1.world-news.optics-for_displays.html> on Nov. 2, 2010,Jan. 1, 2010, 3 pages.
"Position Sensors", Android Developers—retrieved from <http://developer.android.com/guide/topics/sensors/sensors_position.html> on May 25, 2012, 5 pages.
"Reflex LCD Writing Tablets", retrieved from <http://www.kentdisplays.com/products/lcdwritingtablets.html> on Jun. 27, 2012, 3 pages.
"Restriction Requirement", U.S. Appl. No. 13/468,918, Nov. 29, 2013, 6 pages.
"Restriction Requirement", U.S. Appl. No. 13/603,918, Nov. 27, 2013, 8 pages.
"Restriction Requirement", U.S. Appl. No. 13/715,133, Oct. 28, 2013, 6 pages.
"Restriction Requirement", U.S. Appl. No. 13/471,139, Jan. 17, 2013, 7 pages.
"Restriction Requirement", U.S. Appl. No. 13/651,304, Jan. 18, 2013, 7 pages.
"Restriction Requirement", U.S. Appl. No. 13/651,726, Feb. 22, 2013, 6 pages.
"Restriction Requirement", U.S. Appl. No. 13/651,871, Feb. 7, 2013, 6 pages.
"Restriction Requirement", U.S. Appl. No. 13/715,133, Dec. 3, 2013, 6 pages.
"Restriction Requirement", U.S. Appl. No. 13/715,229, Aug. 13, 2013, 7 pages.
"Smart Board™ Interactive Display Frame Pencil Pack", Available at <http://downloads01.smarttech.com/media/sitecore/en/support/product/sbfpd/400series(interactivedisplayframes)/guides/smartboardinteractivedisplayframepencilpackv12mar09.pdf>, 2009, 2 pages.
"SoIRxTM E-Series Multidirectional Phototherapy ExpandableTM 2-Bulb Full Body Panel System", Retrieved from: < http://www.solarcsystems.com/us_multidirectional_uv_light_therapy_1_intro.html > on Jul. 25, 2012, 2011, 4 pages.
"The Microsoft Surface Tablets Comes With Impressive Design and Specs", Retrieved from <http://microsofttabletreview.com/the-microsoft-surface-tablets-comes-with-impressive-design-and-specs> on Jan. 30, 2013, Jun. 2012, 2 pages.
"Tilt Shift Lenses: Perspective Control", retrieved from http://www.cambridgeincolour.com/tutorials/tilt-shift-lenses1.htm, 03/28//2008, 11 Pages.
"Virtualization Getting Started Guide", Red Hat Enterprise Linux 6, Edition 0.2-retrieved from <http://docs.redhat.com/docs/en-US/Red_Hat_Enterprise_Linux/6/html-single/Virtualization_Getting_Started_Guide/index.html> on Jun. 13, 2012, 24 pages.
"Welcome to Windows 7", Retrieved from: <http://www.microsoft.com/en-us/download/confirmation.aspx?id=4984> on Aug. 1, 2013, Sep. 16, 2009, 3 pages.
"What is Active Alignment?", http://www.kasalis.com/active_alignment.html, retrieved on Nov. 22, 2012,Nov. 22, 2012, 2 Pages.
"Write & Learn Spellboard Advanced", Available at <http://somemanuals.com/Vtech,Write%2526Learn—Spellboard—Adv—71000,JIDFHE.PDF>, 2006, 22 pages.
Bathiche, et al.,' "Input Device with Interchangeable Surface", U.S. Appl. No. 13/974,749, Aug. 23, 2013, 51 pages.
Block, et al.,' "DeviceOrientation Event Specification", W3C, Editor's Draft, retrieved from <https://developer.palm.com/content/api/dev-guide/pdk/accessing-device-sensors.html> on May 25, 2012,Jul. 12, 2011, 14 pages.
Brown, "Microsoft Shows Off Pressure-Sensitive Keyboard", retrieved from <http://news.cnet.com/8301-17938_105-10304792-1.html> on May 7, 2012, Aug. 6, 2009, 2 pages.
Butler, et al.,' "SideSight: Multi-"touch" Interaction around Small Devices", In the proceedings of the 21st annual ACM symposium on User interface software and technology., retrieved from <http://research.microsoft.com/pubs/132534/sidesight_crv3.pdf> on May 29, 2012,Oct. 19, 2008, 4 pages.
Crider, "Sony Slate Concept Tablet "Grows" a Kickstand", Retrieved from: <http://androidcommunity.com/sony-slate-concept-tablet-grows-a-kickstand-20120116/> on May 4, 2012, Jan. 16, 2012, 9 pages.
Das, et al.,' "Study of Heat Transfer through Multilayer Clothing Assemblies: A Theoretical Prediction", Retrieved from <http://www.autexrj.com/cms/zalaczone_pliki/5_013_11.pdf>, Jun. 2011, 7 pages.
Dietz, et al.,' "A Practical Pressure Sensitive Computer Keyboard", In Proceedings of UIST 2009, Oct. 2009, 4 pages.
Gaver, et al.,' "A Virtual Window on Media Space", retrieved from <http://www.gold.ac.uk/media/15gaver-smets-overbeeke.
MediaSpaceWindow.chi95.pdf> on Jun. 1, 2012, retrieved from <http://www.gold.ac.uk/media/15gaver-smetsoverbeeke.
MediaSpaceWindow.chi95.pdf> on Jun. 1, 2012,May 7, 1995, 9 pages.
Glatt, "Channel and Key Pressure (Aftertouch).", Retrieved from: <http://home.roadrunner.com/~jgglatt/tutr/touch.htm> on Jun. 11, 2012, 2012, 2 pages.
Hanlon, "ElekTex Smart Fabric Keyboard Goes Wireless", Retrieved from: <http://www.gizmag.com/go/5048/ > on May 7, 2012, Jan. 15, 2006, 5 pages.
Harada, et al.,' "VoiceDraw: A Hands-Free Voice-Driven Drawing Application for People With Motor Impairments", In Proceedings of Ninth International ACM SIGACCESS Conference on Computers and Accessibility, retrieved from <http://citeseerx.ist.psu.edu/viewdoc/download?doi=10.1.1.113.7211&rep=rep1&type=pdf> on Jun. 1, 2012,Oct. 15, 2007, 8 pages.
Iwase, "Multistep Sequential Batch Assembly of Three-Dimensional Ferromagnetic Microstructures with Elastic Hinges", Retrieved at <<http://ieeexplore.ieee.org/stamp/stamp.jsp?tp=&arnumber=1549861>> Proceedings: Journal of Microelectromechanical Systems, Dec. 2005, 7 pages.
Kaufmann, et al.,' "Hand Posture Recognition Using Real-time Artificial Evolution", EvoApplications'09, retrieved from <http://evelyne.lutton.free.fr/Papers/KaufmannEvoIASP2010.pdf> on Jan. 5, 2012,Apr. 3, 2010, 10 pages.
Kaur, "Vincent Liew's redesigned laptop satisfies ergonomic needs", Retrieved from: <http://www.designbuzz.com/entry/vincent-liew-s-redesigned-laptop-satisfies-ergonomic-needs/> on Jul. 27, 2012, Jun. 21, 2010, 4 pages.

(56) References Cited

OTHER PUBLICATIONS

Khuntontong, et al.,' "Fabrication of Molded Interconnection Devices by Ultrasonic Hot Embossing on Thin Polymer Films", IEEE Transactions on Electronics Packaging Manufacturing, vol. 32, No. 3, Jul. 2009, pp. 152-156.
Lance, et al.,' "Media Processing Input Device", U.S. Appl. No. 13/655,065, Oct. 18, 2012, 43 pages.
Li, et al.,' "Characteristic Mode Based Tradeoff Analysis of Antenna-Chassis Interactions for Multiple Antenna Terminals", In IEEE Transactions on Antennas and Propagation, Retrieved from <http://ieeexplore.ieee.org/stamp/stamp.jsp?tp=&arnumber=6060882>,Feb. 2012, 13 pages.
Linderholm, "Logitech Shows Cloth Keyboard for PDAs", Retrieved from: <http://www.pcworld.com/article/89084/logitech_shows_cloth_keyboard_for_pdas.html> on May 7, 2012, Mar. 15, 2002, 5 pages.
Manresa-Yee, et al.,' "Experiences Using a Hands-Free Interface", In Proceedings of the 10th International ACM SIGACCESS Conference on Computers and Accessibility, retrieved from <http://dmi.uib.es/—cmanresay/Research/%5BMan08%5DAssets08.pdf> on Jun. 1, 2012,Oct. 13, 2008, pp. 261-262.
McLellan, "Eleksen Wireless Fabric Keyboard: a first look", Retrieved from: <http://www.zdnetasia.com/eleksen-wireless-fabric-keyboard-a-first-look-40278954.htm> on May 7, 2012, Jul. 17, 2006, 9 pages.
Nakanishi, et al.,' "Movable Cameras Enhance Social Telepresence in Media Spaces", In Proceedings of the 27th International Conference on Human Factors in Computing Systems, retrieved from <http://smg.ams.eng.osaka-u.ac.jp/~nakanishi/hnp_2009_chi.pdf> on Jun. 1, 2012,Apr. 6, 2009, 10 pages.
Piltch, "ASUS Eee Pad Slider SL101 Review", Retrieved from <http://www.laptopmag.com/review/tablets/asus-eee-pad-slider-sl101.aspx>, Sep. 22, 2011, 5 pages.
Post, et al.,' "E-Broidery: Design and Fabrication of Textile-Based Computing", IBM Systems Journal, vol. 39, Issue 3 & 4, Jul. 2000, pp. 840-860.
Prospero, "Samsung Outs Series 5 Hybrid PC Tablet", Retrieved from: <http://blog.laptopmag.com/samsung-outs-series-5-hybrid-pc-tablet-running-windows-8> on Oct. 31, 2013, Jun. 4, 2012, 7 pages.
Purcher, "Apple is Paving the Way for a New 3D GUI for IOS Devices", Retrieved from: <http://www.patentlyapple.com/patently-apple/2012/01/apple-is-paving-the-way-for-a-new-3d-gui-for-ios-devices.html> on Jun. 4, 2012, Retrieved from: <http://www.patentlyapple.com/patently-apple/2012/01/apple-is-paving-the-way-for-a-new-3d-gui-for-ios-devices.html> on Jun. 4, 2012,Jan. 12, 2012, 15 pages.
Qin, et al.,' "pPen: Enabling Authenticated Pen and Touch Interaction on Tabletop Surfaces", In Proceedings of ItS 2010, Available at <http://www.dfki.de/its2010/papers/pdf/po172.pdf>,Nov. 2010, pp. 283-284.
Ramirez, "Applying Solventless Elastomeric Polyurethanes on Concrete in Wastewater Service", In Proceedings: Journal of Protective Coatings and Linings, May 1995, 13 pages.
Reilink, et al.,' "Endoscopic Camera Control by Head Movements for Thoracic Surgery", In Proceedings of 3rd IEEE RAS & EMBS International Conference of Biomedical Robotics and Biomechatronics, retrieved from <http://doc.utwente.nl/74929/1/biorob_online.pdf> on Jun. 1, 2012,Sep. 26, 2010, pp. 510-515.
Sumimoto, "Touch & Write: Surface Computing With Touch and Pen Input", Retrieved from: <http://www.gottabemobile.com/2009/08/07/touch-write-surface-computing-with-touch-and-pen-input/> on Jun. 19, 2012, Aug. 7, 2009, 4 pages.
Sundstedt, "Gazing at Games: Using Eye Tracking to Control Virtual Characters", In ACM SIGGRAPH 2010 Courses, retrieved from <http://www.tobii.com/Global/Analysis/Training/EyeTrackAwards/veronica_sundstedt.pdf> on Jun. 1, 2012,Jul. 28, 2010, 85 pages.
Takamatsu, et al.,' "Flexible Fabric Keyboard with Conductive Polymer-Coated Fibers", In Proceedings of Sensors 2011, Oct. 28, 2011, 4 pages.
Travis, et al.,' "Collimated Light from a Waveguide for a Display Backlight", Optics Express, 19714, vol. 17, No. 22, retrieved from <http://download.microsoft.com/download/D/2/E/D2E425F8-CF3C-4C71-A4A2-70F9D4081007/OpticsExpressbacklightpaper.pdf> on Oct. 15, 2009,Oct. 15, 2009, 6 pages.
Travis, et al.,' "The Design of Backlights for View-Sequential 3D", retrieved from <http://download.microsoft.com/download/D/2/E/D2E425F8-CF3C-4C71-A4A2-70F9D4081007/Backlightforviewsequentialautostereo.docx> on Nov. 1, 2010, 4 pages.
Valli, "Notes on Natural Interaction", retrieved from <http://www.idemployee.id.tue.nl/g.w.m.rauterberg/lecturenotes/valli-2004.pdf> on Jan. 5, 2012, Sep. 2005, 80 pages.
Valliath, "Design of Hologram for Brightness Enhancement in Color LCDs", Retrieved from <http://www.loreti.it/Download/PDF/LCD/44_05.pdf> on Sep. 17, 2012, May 1998, 5 pages.
Vaucelle, "Scopemate, A Robotic Microscope!", Architectradure, retrieved from <http://architectradure.blogspot.com/2011/10/at-uist-this-monday-scopemate-robotic.html> on Jun. 6, 2012,Oct. 17, 2011, 2 pages.
Williams, "A Fourth Generation of LCD Backlight Technology", Retrieved from <http://cds.linear.com/docs/Application%20Note/an65f.pdf>, Nov. 1995, 124 pages.
Xu, et al.,' Hand Gesture Recognition and Virtual Game Control Based on 3D.
Accelerometer and EMG Sensors, IUI'09, Feb. 8-11, 2009, retrieved from <http://sclab.yonsei.ac.kr/courses/10TPR/10TPR.files/Hand%20Gesture%20Recognition%20and%20%20Virtual%20/%20Game/%20Control%20based%20on%203e/020accelerometer%20and%20%20EMG%20sensors.pdf> on Jan. 5, 2012,Feb. 8, 2009, 5 pages.
Xu, et al.,' "Vision-based Detection of Dynamic Gesture", ICTM'09, Dec. 5-6, 2009, retrieved from <http://ieeexplore.ieee.org/stamp/stamp.jsp?tp=&arnumber=5412956> on Jan. 5, 2012, Dec. 5, 2009, pp. 223-226.
Zhang, et al.,' "Model-Based Development of Dynamically Adaptive Software", In Proceedings of ICSE 2006, Available at <http://www.irisa.fr/lande/lande/icse-proceedings/icse/p371.pdf>,May 20, 2006, pp. 371-380.
Zhu, et al.,' "Keyboard before Head Tracking Depresses User Success in Remote Camera Control", In Proceedings of 12th IFIP TC 13 International Conference on Human-Computer Interaction, Part II, retrieved from <http://csiro.academia.edu/Departments/CSIRO_ICT_Centre/Papers?page=5> on Jun. 1, 2012,Aug. 24, 2009, 14 pages.
"Ex Parte Quayle Action", U.S. Appl. No. 13/599,763, filed Nov. 14, 2014, 6 pages.
"Non-Final Office Action", U.S. Appl. No. 13/653,184, filed Dec. 1, 2014, 7 pages.
"Notice of Allowance", U.S. Appl. No. 13/595,700, filed Jan. 21, 2015, 4 pages.
"Notice of Allowance", U.S. Appl. No. 13/715,229, filed Jan. 9, 2015, 6 pages.
"Restriction Requirement", U.S. Appl. No. 13/653,218, filed Nov. 7, 2014, 6 pages.
"Non-Final Office Action", U.S. Appl. No. 13/599,635, filed Feb. 12, 2015, 16 pages.
"Notice of Allowance", U.S. Appl. No. 13/599,763, filed Feb. 18, 2015, 4 pages.

* cited by examiner

METAL ALLOY INJECTION MOLDING PROTRUSIONS

RELATED MATTERS

This application claims priority as a divisional to U.S. patent application Ser. No. 13/715,133, filed Dec. 14, 2012 which claims priority under 35 USC 119(b) to International Application No. PCT/CN2012/083083 filed Oct. 17, 2012, the disclosure of each of which is incorporated by reference in its entirety.

BACKGROUND

Injection molding is a manufacturing process that is conventionally utilized to form articles from plastic. This may include use of thermoplastic and thermosetting plastic materials to form an article, such as a toy, car parts, and so on.

Techniques were subsequently developed to use injection molding for materials other than plastic, such as metal alloys. However, characteristics of the metal alloys could limit use of conventional injection molding techniques to small articles such as watch parts due to complications caused by these characteristics, such as to flow, thermal expansion, and so on.

SUMMARY

Metal alloy injection molding techniques are described. In one or more implementations, these techniques may include adjustment of injection pressure, configuration of runners, and/or use of vacuum pressure, and so on to encourage flow of the metal alloy through a mold. Techniques are also described that utilize protrusions to counteract thermal expansion and subsequent contraction of the metal alloy upon cooling. Further, techniques are described in which a radius of edges of a feature is configured to encourage flow and reduce voids. A variety of other techniques are also described herein.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different instances in the description and the figures may indicate similar or identical items. Entities represented in the figures may be indicative of one or more entities and thus reference may be made interchangeably to single or plural forms of the entities in the discussion.

DETAILED DESCRIPTION

Overview

Conventional injection molding techniques could encounter complications when utilized for a metal alloy. For example, characteristics of the metal alloy may make these conventional techniques unsuitable to make articles over a relatively short length (e.g., larger than a watch part), that are relatively thin (e.g., less than one millimeter), and so on due to such characteristics of thermal expansion, cooling in a mold, and so forth.

Metal alloy injection molding techniques are described. In one or more implementations, techniques are described that may be utilized to support injection molding of a metal alloy, such as a metal alloy that is comprised primarily of magnesium. These techniques include configuration of runners used to fill a cavity of a mold such that a rate of flow is not slowed by the runners, such as to match an overall size of branches of a runner to a runner from which they branch.

In another example, injection pressure and vacuum pressure may be arranged to encourage flow through an entirety of a cavity that is used to form an article. The vacuum pressure, for instance, may be used to bias flow toward portions of the cavity that otherwise may be difficult to fill. This biasing may also be performed using overflows to encourage flow toward these areas, such as areas of the cavity that are feature rich and thus may be difficult to fill using conventional techniques.

In a further example, protrusions may be formed to counteract effects of thermal expansion on an article to be molded. The protrusions, for instance, may be sized to counteract shrinkage caused by a thickness of a feature after the metal alloy cools in the mold. In this way, the protrusions may be used to form a substantially flat surface even though features may be disposed on an opposing side of the surface.

In yet another example, a radius may be employed by features to encourage fill and reduce voids in an article. In a relatively thin article (e.g., less than one millimeter), for instance, sharp corners may cause voids at the corners due to turbulence and other factors encountered in the injection of the metal alloy into a mold. Accordingly, a radius may be utilized that is based at least in part on a thickness of the article to encourage flow and reduce voids. A variety of other examples are also contemplated, further discussion of which may be found in relation to the following sections.

In the following discussion, an example environment is first described that may employ the techniques described herein. Example procedures are then described which may be performed in the example environment as well as other environments. Consequently, performance of the example procedures is not limited to the example environment and the example environment is not limited to performance of the example procedures. It should be readily apparent that these technique may be combined, separated, and so on.

Example Environment

Figure 1:
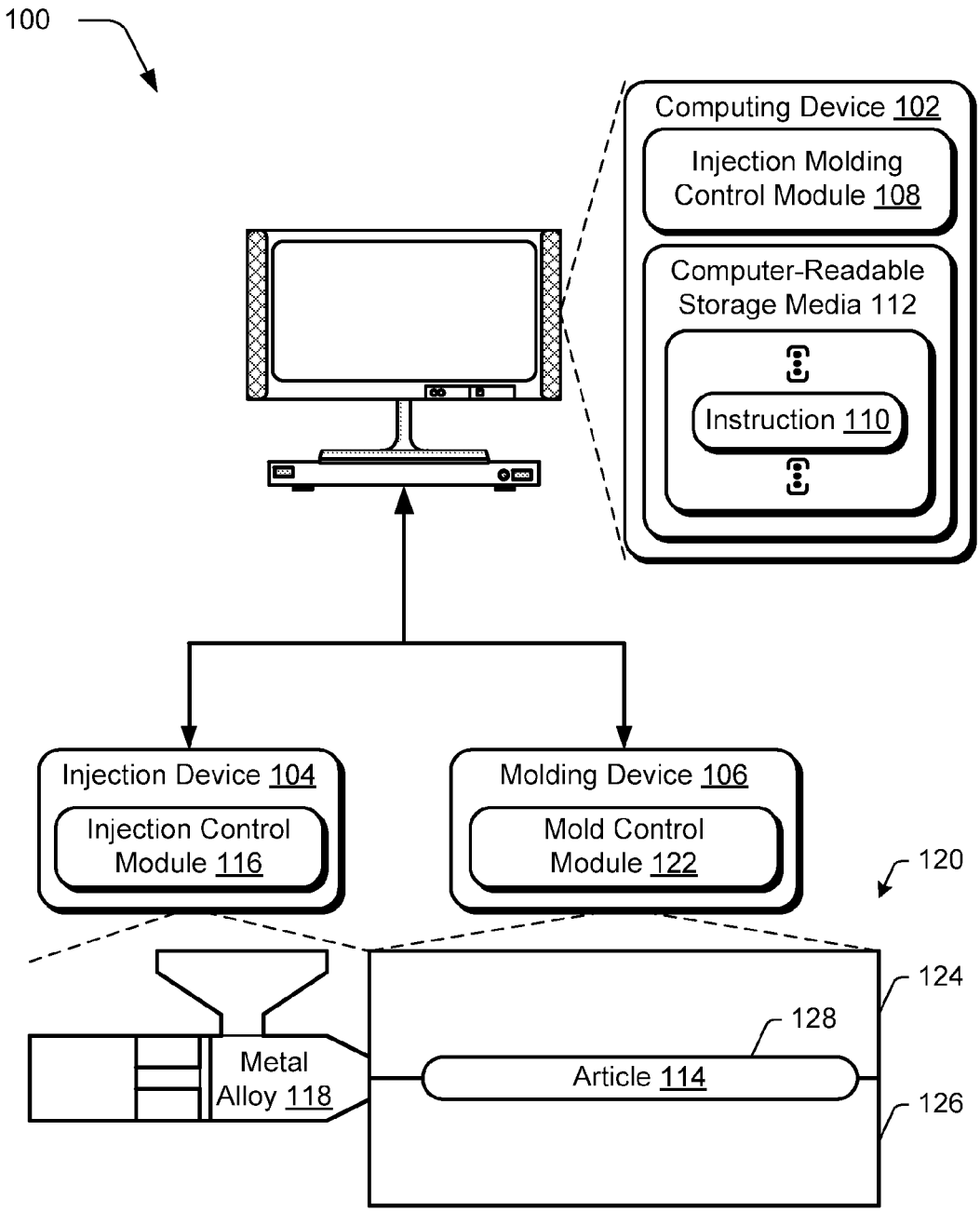
FIG. 1 is an illustration of an environment in an example implementation that is operable to employ injection molding techniques described herein.

FIG. 1 is an illustration of an environment in an example implementation showing a system 100 that is operable to employ injection mold techniques described herein. The illustrated environment includes a computing device 102 that is communicatively coupled to an injection device 104 and a molding device 106. Although illustrated separately, the functionality represented by these apparatus may be combined, further divided, and so on.

The computing device 102 is illustrated as including an injection molding control module 108, which is representative of functionality to control operation of the injection device 104 and molding device 106. The injection molding control module 108, for instance, may utilize one or more instructions 110 stored on a computer-readable storage media 112. The one or more instructions 110 may then be used to control operation of the injection device 104 and molding device 106 to form an article using injection molding.

The injection device 104, for instance, may include an injection control module 116 to control heating and injection of a metal alloy 118 that is to be injected into a mold 120 of the molding device 106. Injection device 104, for instance, may include a heating element to heat and liquefy the metal alloy 118, such as to melt a metal alloy comprised primarily of magnesium to approximately six hundred and fifty degrees Celsius. The injection device 104 may then employ an injector (e.g., a plunger or screw type injector) to inject the metal alloy 118 in liquid form under pressure into the mold 120 of the molding device, such as at approximately forty mPa although other pressures are also contemplated.

The molding device 106 is illustrated as including a mold control module 122, which is representative of functionality to control operation of the mold 120. The mold 120, for instance, may a plurality of mold portions 124, 126. The mold portions 124, 126 when disposed proximal to each other form a cavity 128 that defines the article 114 to be molded. The mold portions 124, 126 may then be moved apart to remove the article 114 from the mold 120.

As previously described, conventional techniques may encounter complications when used to mold an article 114 using a metal alloy 118. For example, an article 114 having walls with a thickness of less than one millimeter may make it difficult to fill an entirety of the cavity 128 to form the article 114 as the metal alloy 118 may not readily flow through the cavity 128 before cooling. This may be further complicated when the article 114 includes a variety of different features that are to be formed on part of the wall, as further described as follows and shown in a corresponding figure.

Figure 2:
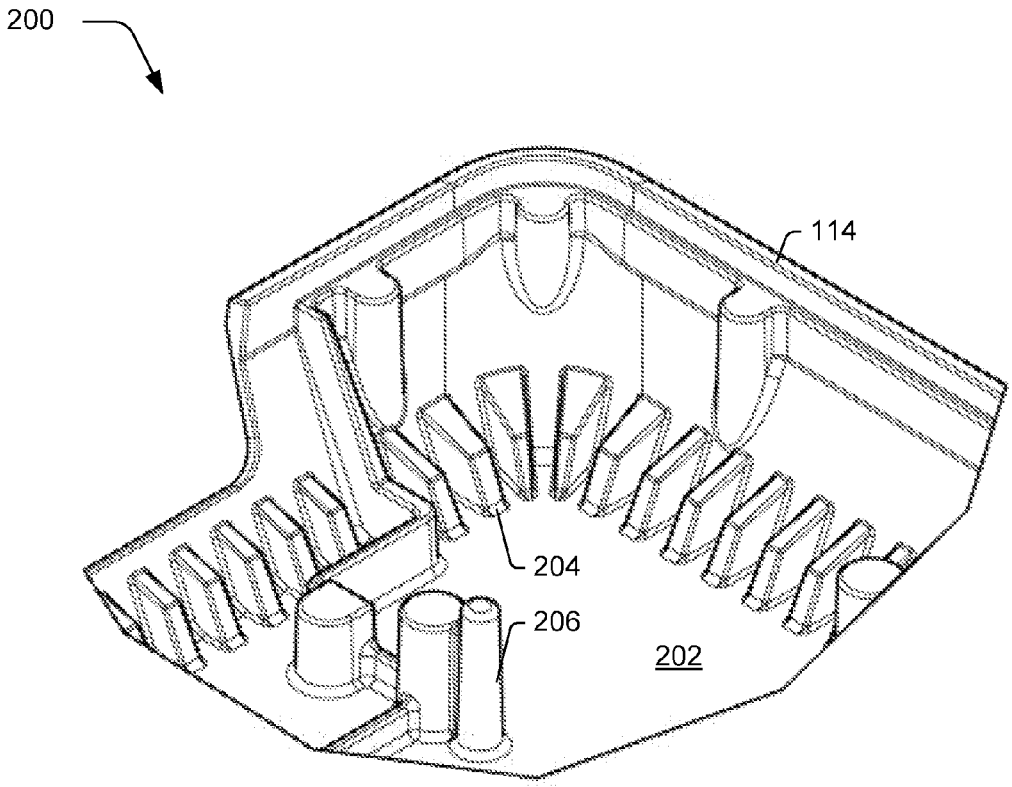
FIG. 2 depicts an example implementation in which features of an article molded using a system of FIG. 1 is shown.

FIG. 2 depicts an example implementation 200 in which features of an article molded using the system 100 of FIG. 1 is shown. In this example, the article 114 is configured to form part of a housing for a computing device in a hand held form factor, e.g., tablet, mobile phone, game device, music device, and so on.

The article 114 in this instance includes portions that define a wall 202 of the article 114. Features 204, 206 are also included that extend away from the wall 202 and thus have a thickness that is greater than the wall. Additionally, the features 204, 206 may have a width that is considered relatively thin in comparison with this thickness. Accordingly, in form factors in which the wall is also considered thin (e.g., less than one millimeter) it may be difficult to get the metal alloy 118 to flow into these features using conventional techniques.

Figure 3:
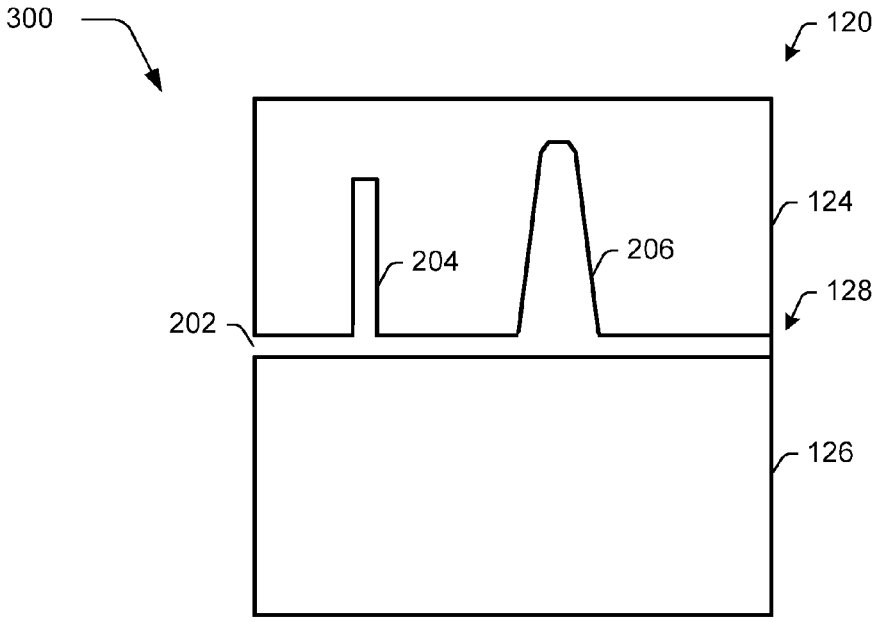
FIG. 3 depicts an example implementation in which a cavity defined by mold portions may be shaped to form a wall and features of FIG. 2.

As shown in the example implementation 300 of FIG. 3, for instance, a cavity 128 defined by the mold portions 124, 126 may be shaped to form the wall 202 and the features 204, 206. A flow of the metal alloy 118 into the cavity 128 at relatively thin thickness may cause the metal alloy 114 to cool before filling the cavity 128 and thus may be leave voids in the cavity 128 between the metal alloy 114 and surfaces of the cavity 128. These voids may consequently have an adverse effect on the article 114 being molded. Accordingly, techniques may be employed to reduce and even eliminate formation of the voids, an example of which is described in the following discussion and corresponding figure.

Figure 4:
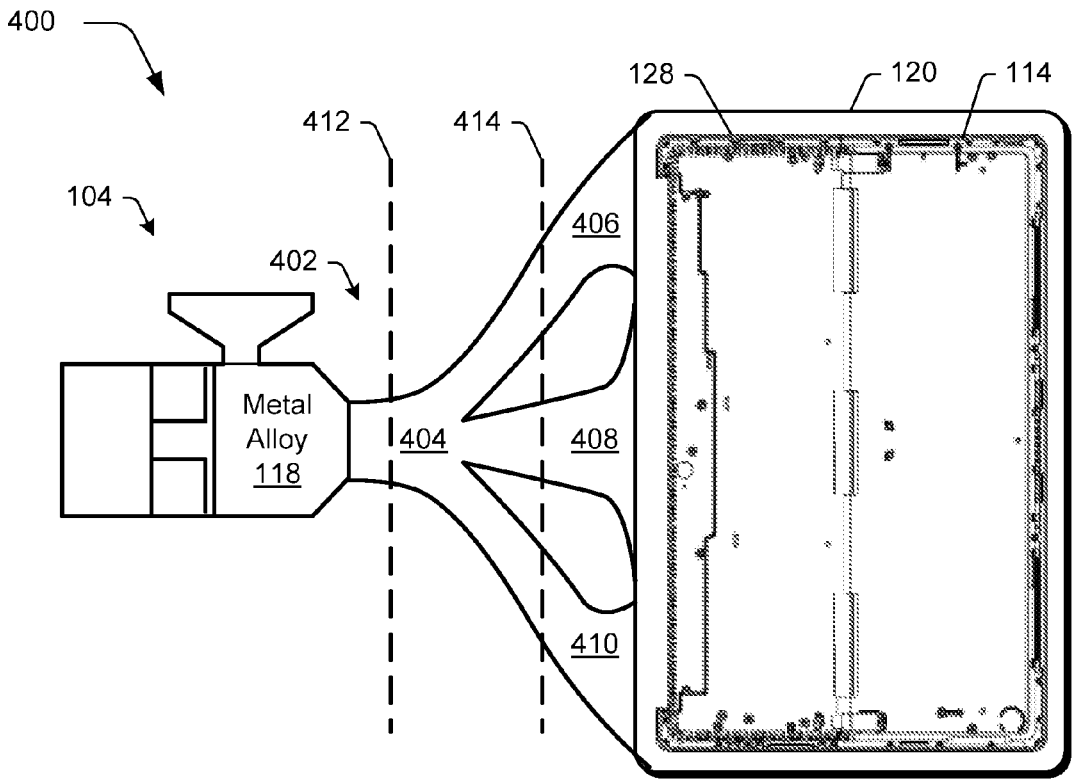
FIG. 4 depicts a system in an example implementation in which an injection distribution device is used to physically couple an outflow of injected metal alloy from an injection device to a mold of a molding device.

FIG. 4 depicts a system 400 in an example implementation in which an injection distribution device 402 is used to physically couple an outflow of the injected metal alloy from the injection device 104 to a mold 120 of the molding device 106. Pressure used to inject the metal alloy 118 to form the article 114 may set to encourage a uniform fill of the cavity 128 of the mold 120.

For example, a pressure may be employed by the injection device 104 that is sufficient to form an alpha layer (e.g., skin) on an outer surface of the metal alloy 118 as it flows through the mold 120. The alpha layer, for instance, may have a higher density at a surface than in the "middle" of the metal alloy 118 when flowing into the mold 120. This may be formed based at least in part using relatively high pressures (such as around 40 mega Pascals) such that the skin is pressed against a surface of the mold 120 thereby reducing formation of voids. Thus, the thicker the alpha layer the less chance of forming voids in the mold 120.

Additionally, an injection distribution device 402 may be configured to encourage this flow from the injection device 104 into the mold 120. The injection device 402 in this example includes a runner 404 and a plurality of sub-runners 406, 408, 410. The sub-runners 406-410 are used to distribute the metal alloy 118 into different portions of the mold 120 to promote a generally uniform application of the metal alloy 118.

However, conventional injection distribution devices were often configured such that a flow of the metal alloy 118 or other material was hindered by the branches of the device. The branches formed by sub-runners of convention devices, for instance, may be sized such as to cause an approximate forty percent flow restriction between a runner and the sub-runners that were configured to receive the metal alloy 118. Thus, this flow restriction could cause cooling of the metal alloy 118 as well as counteract functionality supported through use of particular pressures (e.g., about 40 mega Pascals) used to form alpha layers.

Accordingly, the injection distribution device 402 may be configured such that a decrease in flow of the metal alloy 118 through the device is not experienced. For example, a size of a cross section 412 taken of the runner 404 may be approximated by an overall size of a cross section 414 taken of the plurality of sub-runners 406, 408, 410, which is described further below and shown in relation to a corresponding figure.

Figure 5:
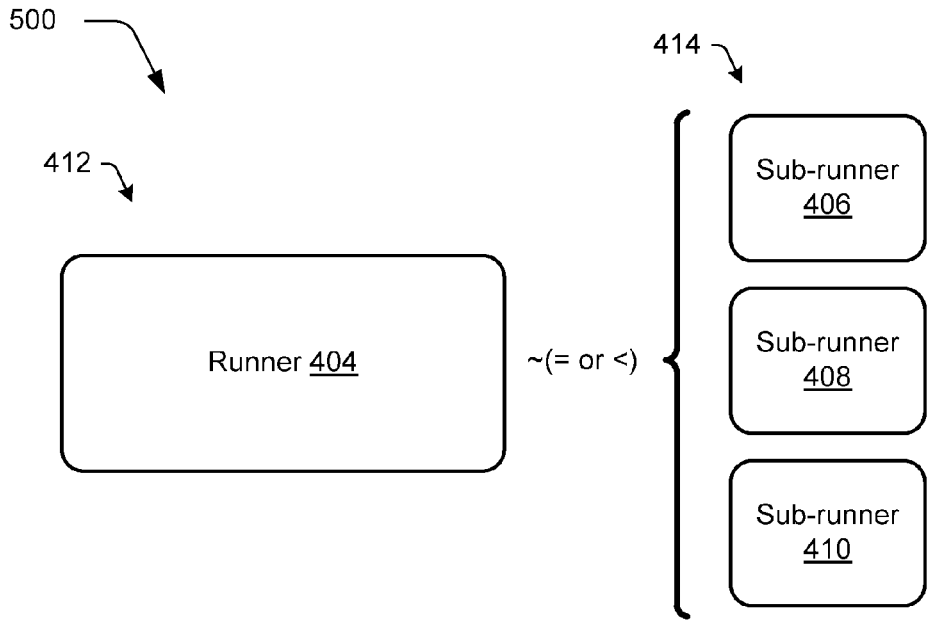
FIG. 5 depicts an example implementation showing comparison of respective cross sections of the runner and the plurality of sub-runners of FIG. 4.

FIG. 5 depicts an example implementation 500 showing comparison of respect cross sections 412, 414 of the runner 404 and the plurality of sub-runners 406-410. The cross section 412 of the runner 404 is approximately equal to or less than a cross section 414 overall of the plurality of sub-runners 406-408. This may be performed by varying a diameter (e.g., including height and/or width) such that flow is not reduced as the metal alloy 118 passes through the injection distribution device 104.

For example, the runner 404 may be sized to coincide with an injection port of the injection device 104 and the plurality of sub-runners 406-410 may get progressively shorter and wider to coincide with a form factor of the cavity 128 of the mold 120. Additionally, although a single runner 404 and three sub-runners 406-410 are shown it should be readily apparent that different numbers and combinations are also contemplated without departing from the spirit and scope thereof. Additional techniques may also be employed to reduce a likelihood of voids in the article, another example of which is described as follows.

Figure 6:
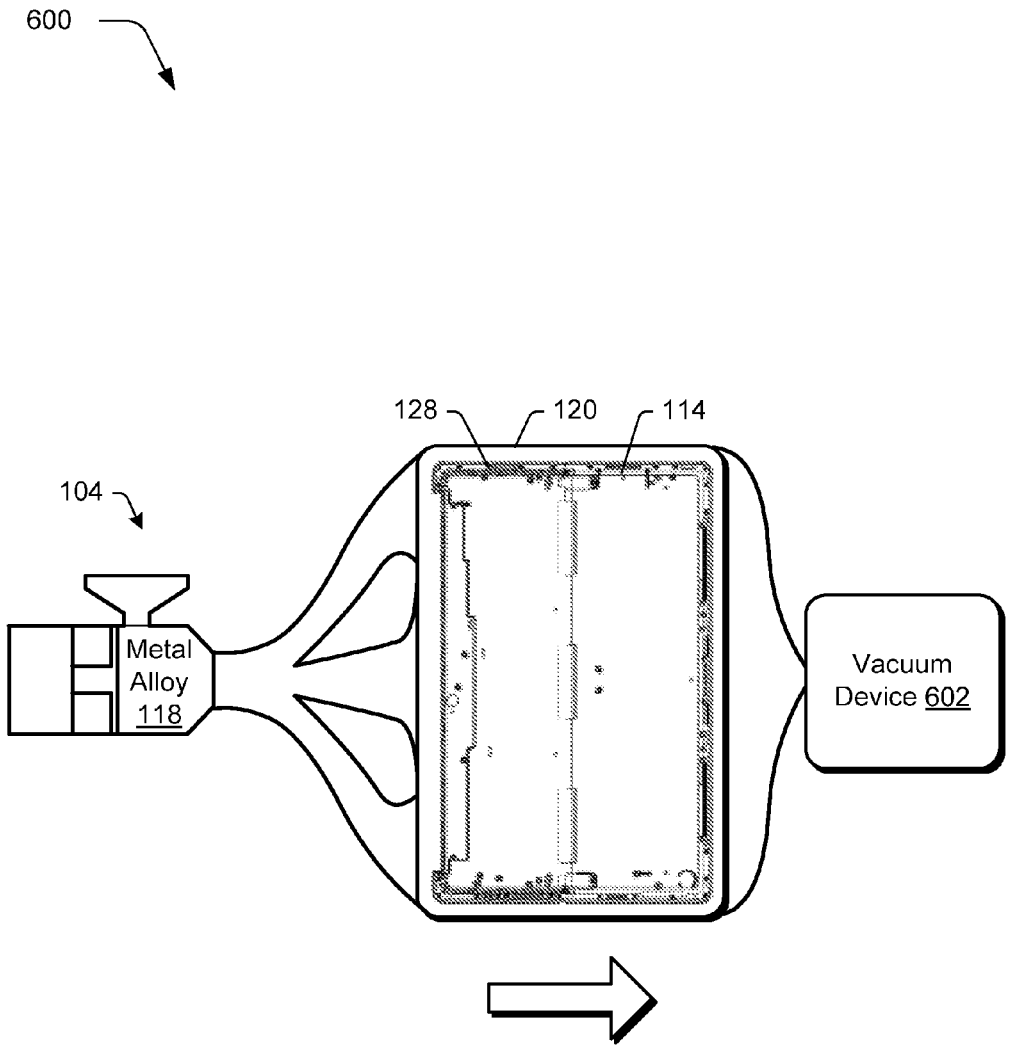
FIG. 6 depicts a system in an example implementation in which a vacuum device is employed to create negative pressure inside a cavity of the mold to promote flow of the metal alloy.

FIG. 6 depicts a system 600 in an example implementation in which a vacuum device is employed to create negative pressure inside a cavity of the mold 120 to promote flow of the metal alloy 118. As previously described, metal alloys 118 such as one primarily comprised of magnesium may be resistant to flow, especially for thickness that are less than a millimeter. This problem may be exacerbated when confronted with forming an article that is approximately two hundred millimeters long or greater and thus conventional techniques were limited to articles smaller than that.

For example, it may be difficult using conventional techniques to fill a cavity under conventional techniques to form a part of a housing of a computing device that has walls having a thickness of approximately 0.65 millimeters and width and length of greater than 100 millimeters and one hundred and fifty millimeters, respectively (e.g., approximately 190 millimeters by 240 millimeters for a tablet). This is because the metal alloy 118 may cool and harden, especially at those thicknesses and lengths due to the large amount of surface area in comparison with thicker and/or shorter articles. However, the techniques described herein may be employed to form such an article.

In the system 600 of FIG. 6, a vacuum device 602 is employed to bias a flow of the metal alloy 118 through the cavity 128 to form the article 114. For example, the vacuum device 602 may be configured to form negative pressure within the cavity 128 of the mold 120. The negative pressure (e.g., 0.4 bar) may include a partial vacuum formed to remove air from the cavity 218, thereby reducing a chance of formation of air pockets as the cavity 128 is filled with the metal alloy 118.

Further, the vacuum device 602 may be coupled to particular areas of the mold 120 to bias the flow of the metal alloy 118 in desired ways. The article 114, for instance, may include areas that are feature rich (e.g., as opposed to sections having fewer features, the wall 202, and so on) and thus may restrict flow in those areas. Additionally, particular areas might be further away from an injection port (e.g., at the corners that are located closer to the vacuum device 602 than the injection device 104).

In the illustrated instance, the vacuum device 602 is coupled to areas that are opposite areas of the mold 120 that receive the metal alloy 118, e.g., from the injection device 104. In this way, the metal alloy 118 is encouraged to flow through the mold 120 and reduce voids formed within the mold 120 due to incomplete flow, air pockets, and so on. Other techniques may also be employed to bias flow of the metal alloy 118, another example of which is described as follows and shown in an associated figure.

Figure 7:
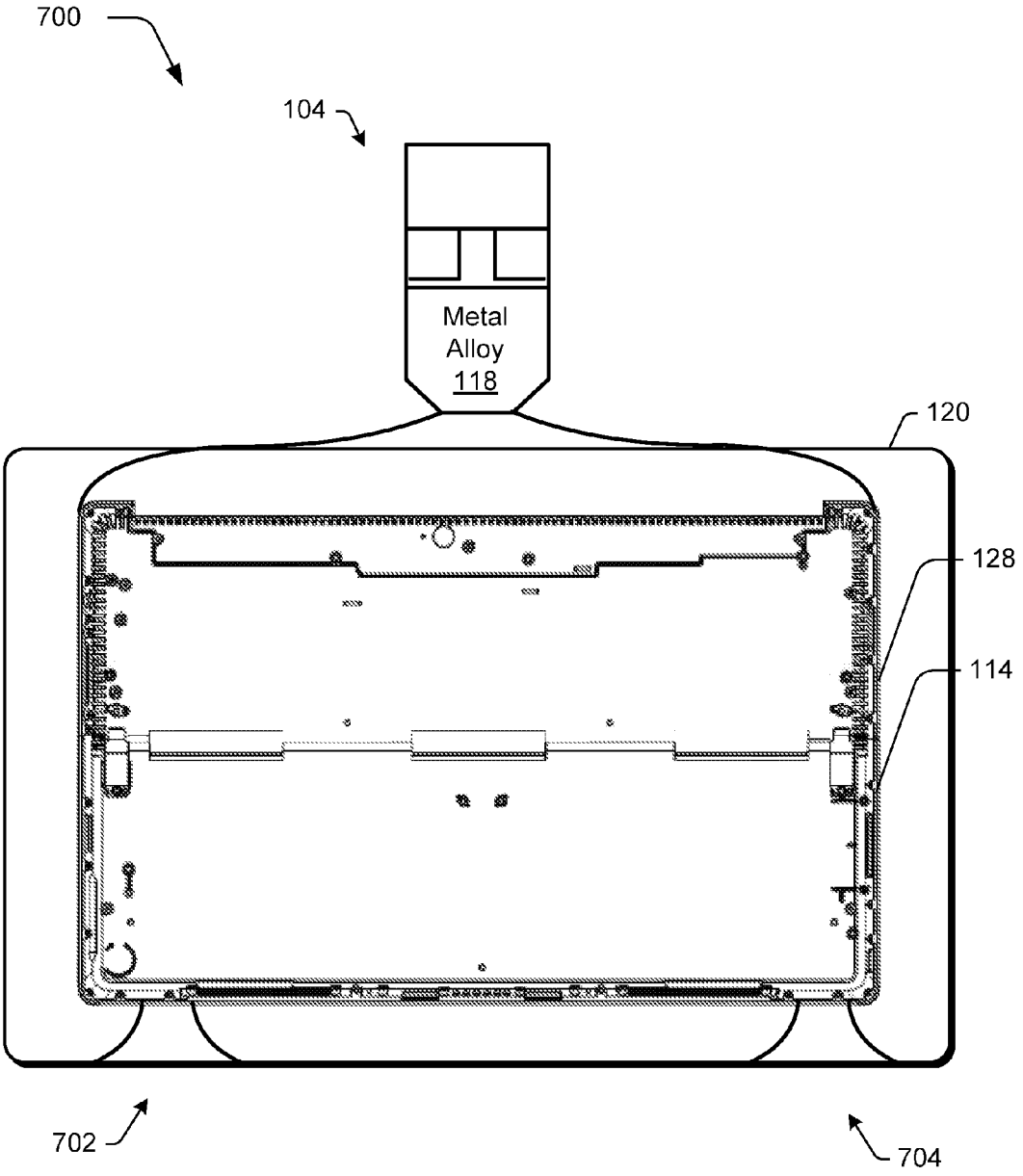
FIG. 7 depicts a system in an example implementation in which a mold includes one or more overflows to bias a flow of metal alloy through a mold.

FIG. 7 depicts a system 700 in an example implementation in which a mold 120 includes one or more overflows 702, 704 to bias a flow of metal alloy 118 through a mold 120. As previously described, characteristics of the article 114 to be molded may cause complications, such as due to relative thinness (e.g., less than one millimeter), length of article (e.g., 100 millimeters or over), shape of article 114 (e.g., to reach corners on the opposing side of the cavity 128 from the injection device 104), features and feature density, and so on. These complications may make it difficult to get the metal alloy 118 to flow to particular portions of the mold 120, such as due to cooling and so forth.

In this example, overflows 702, 704 are utilized to bias flow of the metal alloy 118 towards the overflows 702, 704. The overflows 702, 704, for instance, may bias flow toward the corners of the cavity 128 in the illustrated example. In this way, a portion of the cavity 128 that may be otherwise difficult to fill may be formed using the metal alloy 118 without introducing voids. Other examples are also contemplated, such as to position the overflows 702, 704 based on feature density of corresponding portions of the cavity 128 of the mold 120. Once cooled, material (e.g., the metal alloy 118) disposed within the overflows 702, 704 may be removed to form the article 114, such as by a machining operation.

Thus, the overflows 702, 704 may be utilized to counteract a "cold material" condition in which the material (e.g., the metal alloy 118) does not fill the cavity 128 completely, thus forming voids such as pinholes. The colder material, for instance, may exit the overflows 702, 704 thus promoting contact of hotter material (e.g., metal alloy 118 still in substantially liquid form) to form the article 114. This may also aide a microstructure of the article 114 due to the lack of imperfections as could be encountered otherwise.

Figure 8:
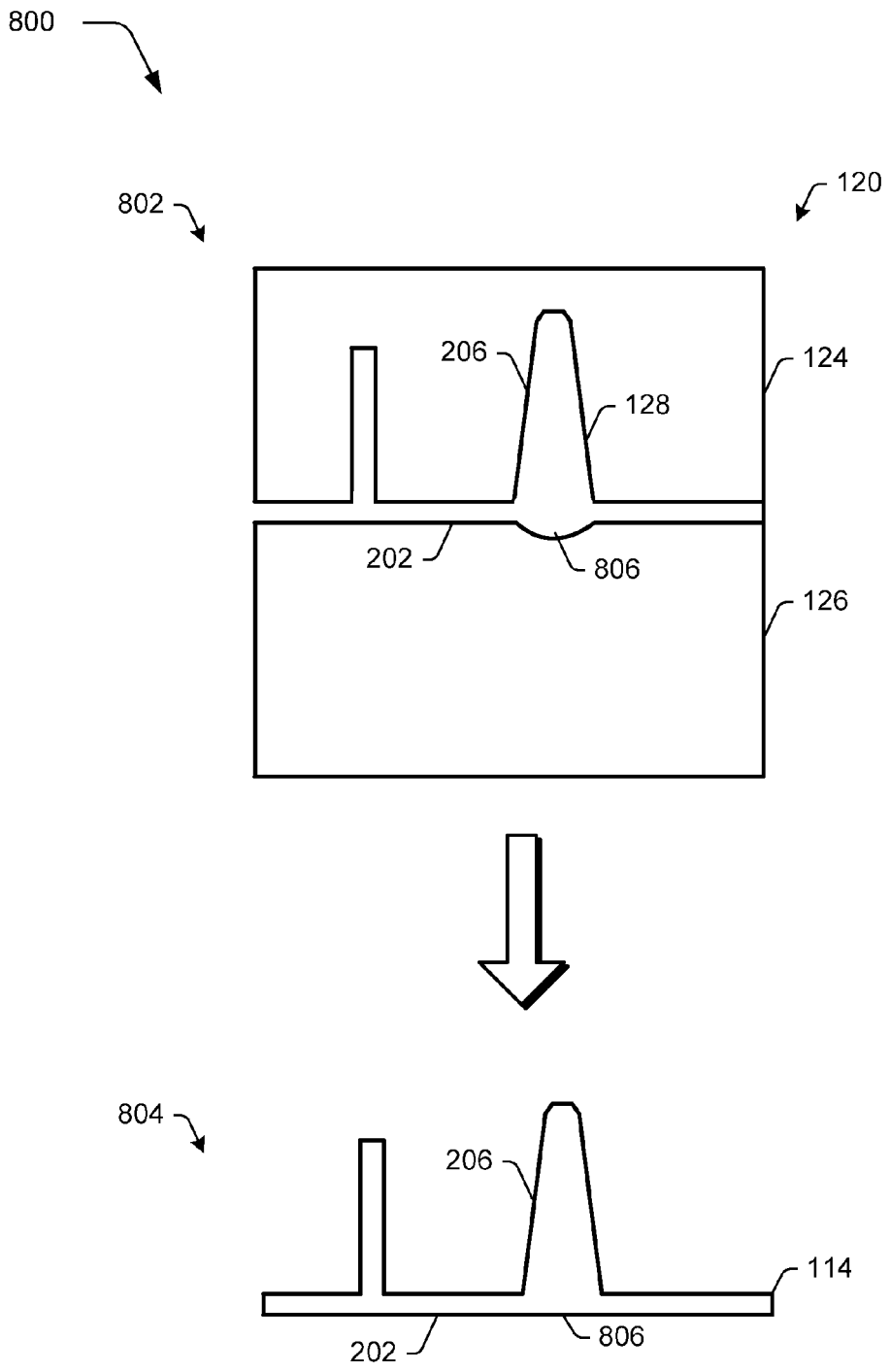
FIG. 8 depicts an example implementation in which a protrusion is utilized to reduce an effect of thermal expansion caused by varying degrees of thickness of an article to be molded.

FIG. 8 depicts an example implementation 800 in which a protrusion is utilized to reduce an effect of thermal expansion caused by varying degrees of thickness of an article 114 to be molded. As previously described, injection molding was traditionally utilized to form plastic parts. Although these techniques were then expanded to metal alloys, conventional techniques were limited to relatively small sizes (e.g., watch parts) due to thermal expansion of the material, which could cause inconsistencies in articles larger than a relatively small size, e.g., watch parts. However, techniques are described herein which may utilized to counteract differences in thermal expansion, e.g., due to differences in thickness of the article, and as such may be used to support manufacture of larger articles, such as articles over 100 millimeters.

The example implementation 800 is illustrated using first and second stages 802, 804. At the first stage 802, the mold 120 is shown as forming a cavity 128 to mold an article. The cavity 128 is configured to have different thicknesses to mold different parts of the article 114, such as a wall 202 and a feature 206. As illustrated, the feature 206 has a thickness that is greater than a thickness of the wall 202. Accordingly, the feature 206 may exhibit a larger amount of contraction than the wall 202 due to thermal expansion of the metal alloy 118. Using conventional techniques, this caused a depression in a side of the article that is opposite to the feature 206. This depression made formation of a substantially flat surface on a side of the article that opposed the feature 206 difficult if not impossible using conventional injection molding techniques.

Accordingly, the cavity 126 of the mold may be configured to form a protrusion 806 on an opposing side of the feature. The protrusion 806 may be shaped and sized based at least in part on thermal expansion (and subsequent contraction) of the metal alloy 118 used to form the article. The protrusion 806 may be formed in a variety of ways, such as to have a minimum radius of 0.6 mm, use of angles of thirty degrees or less, and so on.

Therefore, once the metal alloy 118 cools and solidifies as shown in the second stage 804, the article 114 may form a substantially flat surface that includes an area proximal to an opposing side of the feature as well as the opposing side of the feature 206, e.g., the wall 202 and an opposing side of the feature 206 adjacent to the wall 202. In this way, the article 114 may be formed to have a substantially flat surface using a mold 120 having a cavity 128 that is not substantially flat at a corresponding portion of the cavity 128 of the mold 120.

Figure 9:
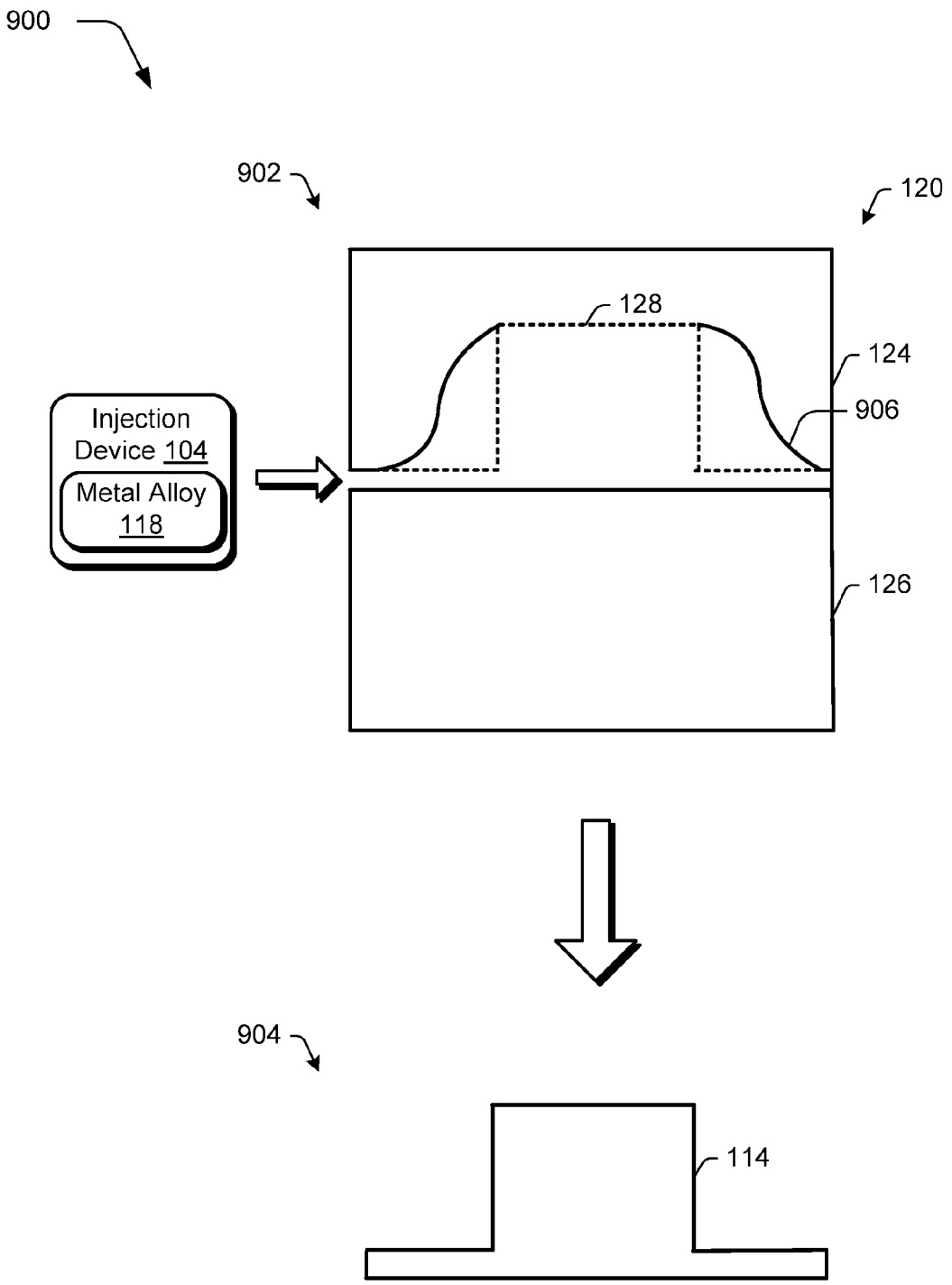
FIG. 9 depicts an example implementation in which a mold is employed that includes edges configured to reduce voids.

FIG. 9 depicts an example implementation 900 in which a mold is employed that includes edges configured to reduce voids. This implementation 900 is also shown using first and second stage 902, 904. As previously described, injection molding was traditionally performed using plastics. However, when employed to mold a metal alloy 118, conventional techniques could be confronted with reduced flow characteristics of the metal alloy 118 in comparison with the plastics, which could cause voids.

Accordingly, techniques may be employed to reduce voids in injection molding using a metal alloy 118. For example, at the first stage 902 molding portions 124, 126 of the mold 120 are configured to form a cavity 128 as before to mold an article 114. However, the cavity 128 is configured to employ radii and angles that promote flowability between the surface of the cavity 218 and the metal alloy 118 to form the article 114 without voids.

For example, the article 114 may be configured to include portions (e.g., a wall) that have a thickness of less than one millimeter, such as approximately 0.65 millimeter. Accordingly, a radius 906 of approximately 0.6 to 1.0 millimeters may be used to form an edge of the article 114. This radius 906 is sufficient to promote flow of a metal alloy 118 comprised primarily of magnesium through the cavity 128 of the mold 120 from the injection device 104 yet still promote contact. Other radii are also contemplated, such as one millimeter, two millimeters, and three millimeters. Additionally, larger radii may be employed with articles having less thickness, such as a radius of approximately twelve millimeters for an article 114 having walls with a thickness of approximately 0.3 millimeters.

In one or more implementations, these radii may be employed to follow a likely direction of flow of the metal alloy 118 through the cavity 128 in the mold 120. A leading and/or trailing edge of a feature aligned perpendicular to the flow of the metal alloy 118, for instance, may employ the radii described above whereas other edges of the feature that run substantially parallel to the flow may employ "sharp" edges that do not employ the radii, e.g., have a radius of less than 0.6 mm for an article 114 having walls with a thickness of approximately 0.65 millimeters.

Additionally, techniques may be employed to remove part of the metal alloy 118 to form a desired feature. The metal alloy 118, for instance, may be shaped using the mold 120 as shown in the first stage 902. At the second stage, edges of the article 114 may be machined to "sharpen" the edges, e.g., stamping, grinding, cutting, and so on. Other examples are also contemplated as further described in the following discussion of the example procedures.

Example Procedures

The following discussion describes injection molding techniques that may be implemented utilizing the previously described systems and devices. Aspects of each of the procedures may be implemented in hardware, firmware, or software, or a combination thereof. The procedures are shown as a set of blocks that specify operations performed by one or more devices and are not necessarily limited to the orders shown for performing the operations by the respective blocks. In portions of the following discussion, reference will be made to FIGS. 1-9.

Figure 10:
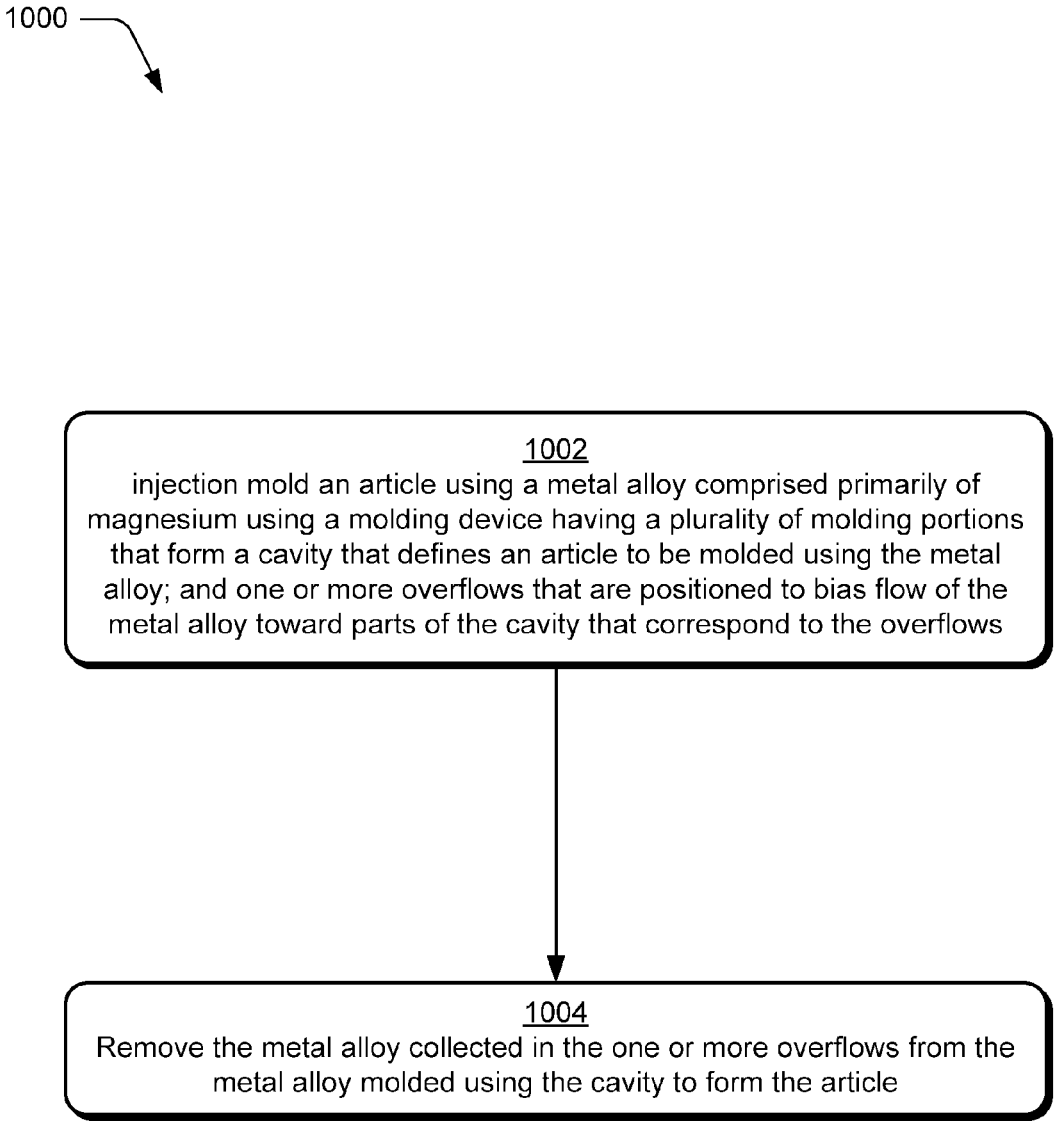
FIG. 10 is a flow diagram depicting a procedure in an example implementation in which an article is injected molded using a mold that employs overflows.

FIG. 10 depicts a procedure 1000 in an example implementation in which an article is injection molded using a mold that employs overflows. An article is injection molded using a metal alloy comprised primarily of magnesium using a molding device having a plurality of molding portions that form a cavity that defines an article to be molded using the metal alloy and one or more overflows that are positioned to bias flow of the metal alloy toward parts of the cavity that correspond to the overflows (block 1002). As shown in FIG. 7, for instance, the overflows 702, 704 may be positioned to bias flow towards associated regions of the mold 120. The overflows 702, 704 may also be used to remove metal alloy 118 that has cooled during flow through the mold 120 such that subsequent metal alloy that is injected into the mold 120 may remain in a liquid form sufficient to contact the surface of the cavity as opposed to the cooled metal alloy 118 that may cause pin holes and other imperfections.

The metal alloy collected in the one or more overflows is removed from the metal alloy molded using the cavity to form the article (block 1004). This may be performed using a stamping, machining, or other operation in which the metal alloy 118 disposed in the overflows is separated from the metal alloy 118 in the cavity 128 of the mold 120 that is used to form the article 114, e.g., a housing of a hand-held computing device such as a tablet, phone, and so on.

Figure 11:
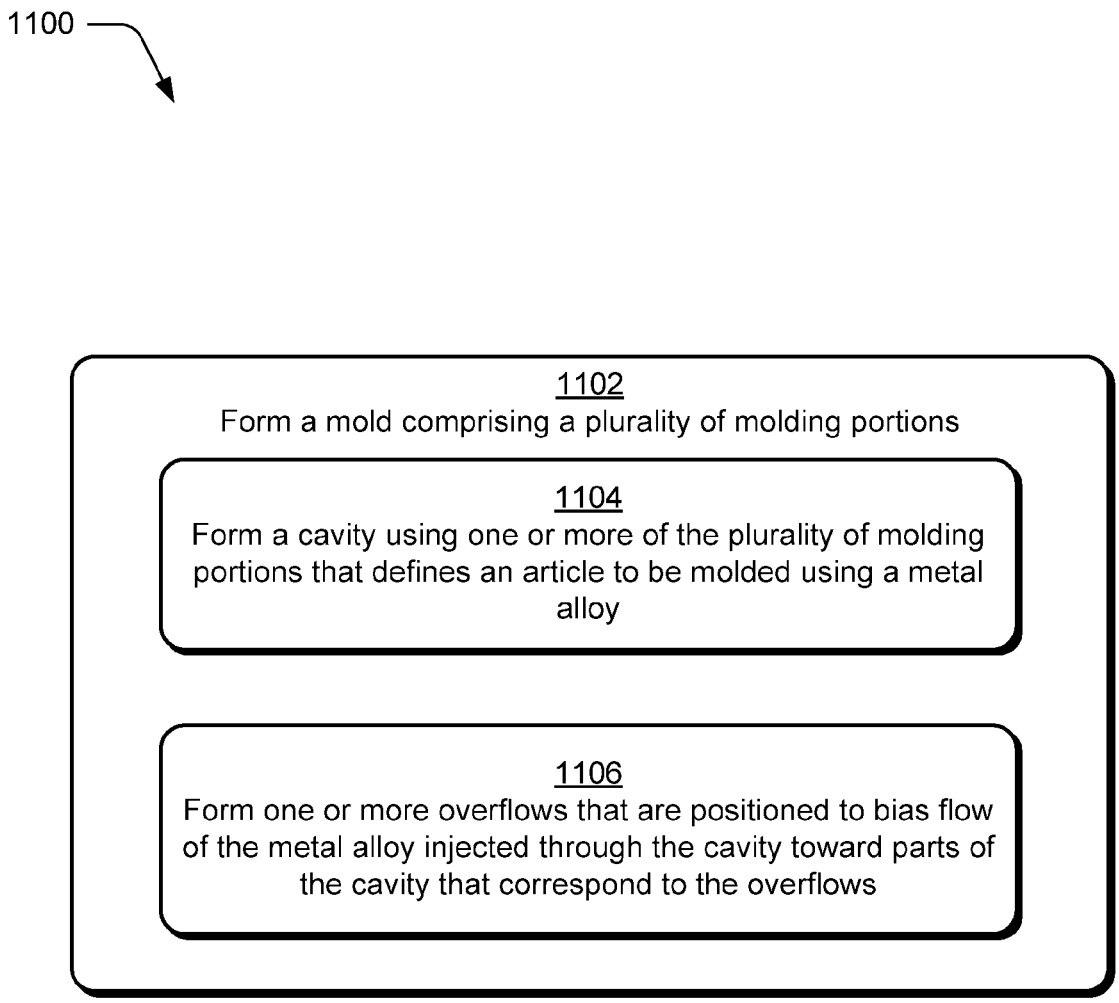
FIG. 11 is a flow diagram depicting a procedure in an example implementation in which a mold is formed that employs overflows.

FIG. 11 depicts a procedure 1100 in an example implementation in which a mold is formed that employs overflows. A mold is formed that includes a plurality of molding portions (block 1102). The molding portions may be used to form a cavity that define an article to be molded using a metal alloy (block 1104), such as a metal alloy comprised primarily of magnesium.

One or more flows may also be formed as part of the molding portions that are positioned to bias flow of the metal alloy injected through the cavity toward parts of the cavity that correspond to the overflows (block 1106). As before, these overflows may be positioned due to feature density of the article, difficult locations of the cavity to fill, located to remove "cooled" metal alloy, and so on.

Figure 12:
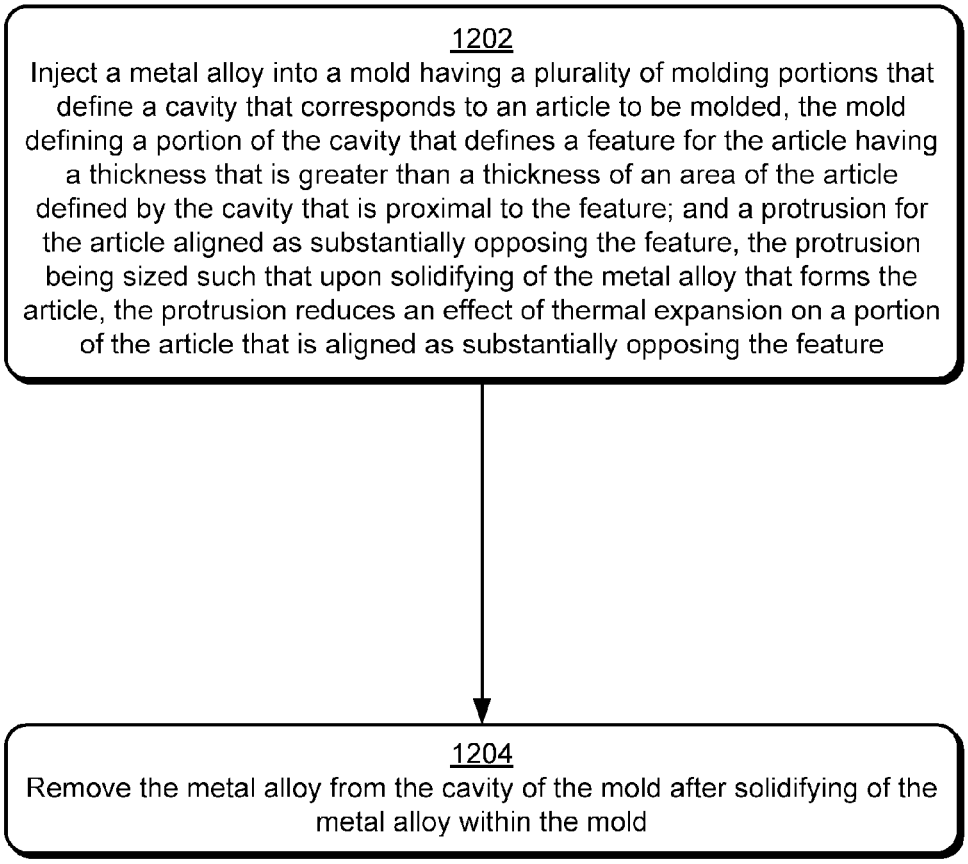
FIG. 12 is a flow diagram depicting a procedure in an example implementation in which a protrusion is formed to at least partially counteract thermal expansion of the metal alloy and subsequent contraction caused by cooling of the metal alloy.

FIG. 12 depicts a procedure 1200 in an example implementation in which a protrusion is formed to at least partially counteract thermal expansion of the metal alloy and subsequent contraction caused by cooling of the metal alloy. A metal alloy is injected into a mold having a plurality of molding portions that define a cavity that corresponds to an article to be molded. The mold defines a portion of the cavity that defines a feature for the article having a thickness that is greater than a thickness of an area of the article defined by the cavity that is proximal to the feature. The mold also defines a protrusion for the article aligned as substantially opposing the feature, the protrusion being sized such that upon solidifying of the metal alloy that forms the article, the protrusion reduces an effect of thermal expansion on a portion of the article that is aligned as substantially opposing the feature (block 1202).

The protrusion, for instance, may be formed as an indention in part of the cavity 128 of the mold 120.

The metal alloy is removed from the cavity of the mold after solidifying of the metal alloy within the mold (block 1204). As stated above, the protrusion may be used to offset an effect of thermal expansion and subsequent contraction of the metal alloy 118, such as to form a substantially flat surface on a side of the article opposite to the feature.

Figure 13:
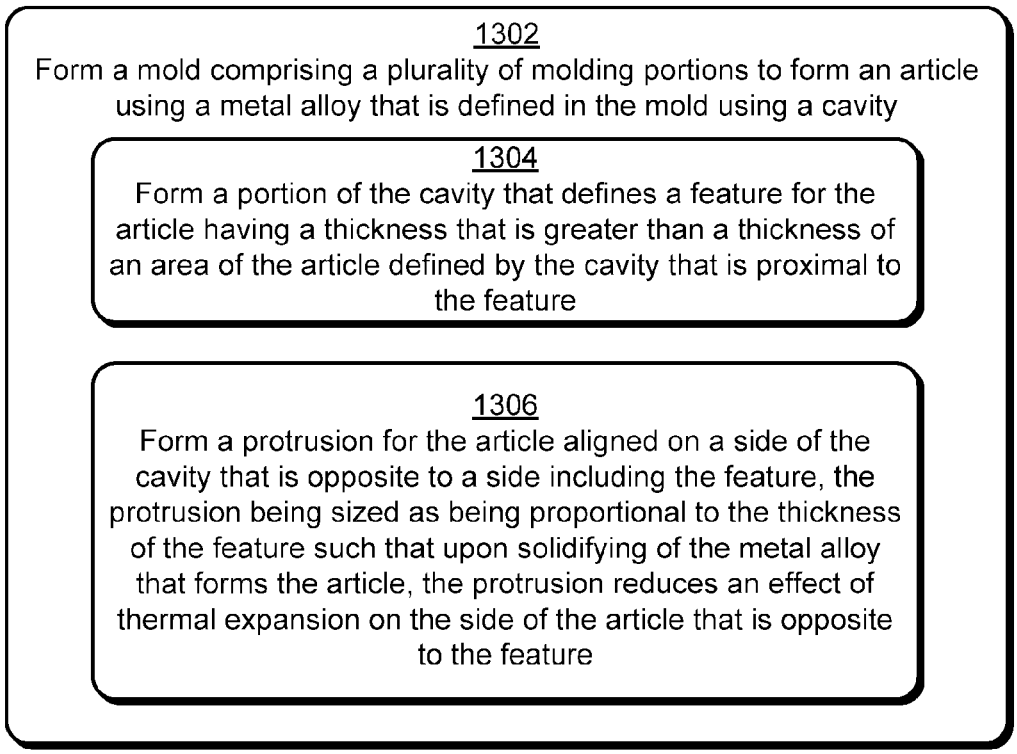
FIG. 13 is a flow diagram depicting a procedure in an example implementation in which a mold is formed that is configured to form a protrusion on an article to counteract an effect of thermal expansion.

FIG. 13 depicts a procedure 1300 in an example implementation in which a mold is formed that is configured to form a protrusion on an article to counteract an effect of thermal expansion. A mold is formed having a plurality of molding portions to form an article using a metal alloy that is defined in the mold using a cavity (block 1302). This may include forming a portion of the cavity that defines a feature for the article having a thickness that is greater than a thickness of an area of the article defined by the cavity that is proximal to the feature (block 1304).

The mold may also be configured to form a protrusion for the article aligned on a side of the cavity that is opposite to a side including the feature, the protrusion being sized as being proportional to the thickness of the feature such that upon solidifying of the metal alloy that forms the article, the protrusion reduces an effect of thermal expansion on the side of the article that is opposite to the feature (block 1306). In this way, subsequent cooling of the metal alloy and corresponding contraction may be addressed to reduce the effect of the thermal expansion on the article.

Figure 14:
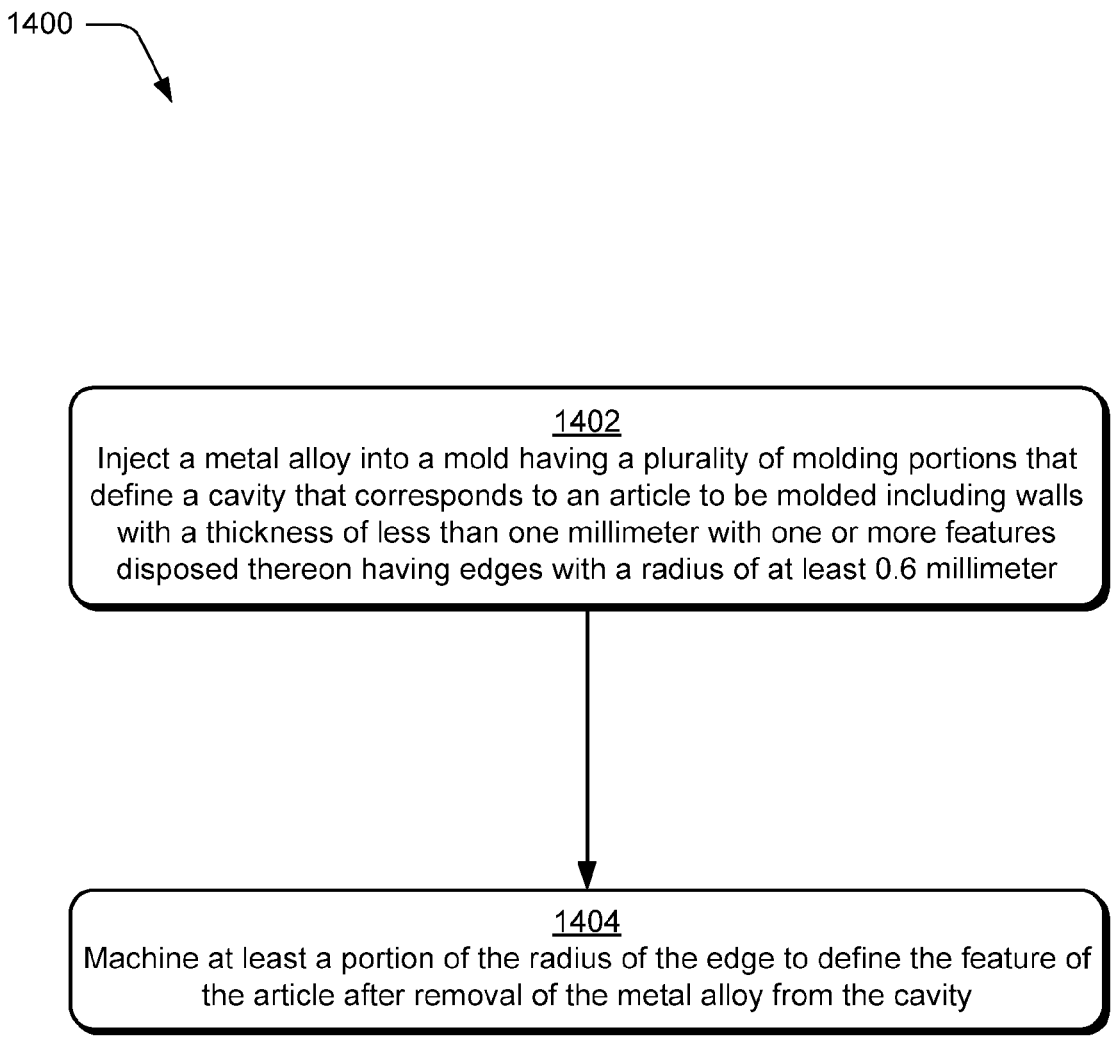
FIG. 14 is a flow diagram depicting a procedure in an example implementation in which a radius is employed to limit formation of voids of the article.

FIG. 14 depicts a procedure 1400 in an example implementation in which a radius is employed to limit formation of voids of the article. A metal alloy is injected into a mold having a plurality of molding portions that define a cavity that corresponds to an article to be molded including walls with a thickness of less than one millimeter with one or more features disposed thereon having edges with a radius of at least 0.6 millimeter (block 1402). As previously described, metal alloys may introduce complications not encountered using plastics, such as quicker cooling and resistance to flow through a mold 120, especially for articles having a thickness of under one millimeter. Accordingly, the radius may be employed to reduce voids caused by sharp edges.

At least a portion of the radius of the edge is machined to define the feature of the article after removal of the metal alloy from the cavity (block 1404). In this way, a sharp edge may be provided on the device yet a likelihood of voids reduced. A variety of other examples are also contemplated as previously described in relation to FIG. 9.

CONCLUSION

Although the invention has been described in language specific to structural features and/or methodological acts, it is to be understood that the invention defined in the appended claims is not necessarily limited to the specific features or acts described. Rather, the specific features and acts are disclosed as example forms of implementing the claimed invention.

What is claimed is:

1. A molding device comprising:

a mold having a plurality of molding portions that define a cavity that corresponds to an article to be molded using a metal alloy that is injected into the mold, the mold defining:

a portion of the cavity that defines a feature for the article having a thickness that is greater than a thickness of an area of the article defined by the cavity that is proximal to the feature; and a protrusion for the article aligned on a side of the cavity that is opposite to a side including the feature, the protrusion being sized such that upon solidifying of the metal alloy that forms the article, the protrusion shrinks to form a substantially flat surface to the side that is opposite to the feature.

2. A molding device as described in claim 1, wherein the protrusion is sized as proportional to the thickness of the feature.

3. A molding device as described in claim 2, wherein the protrusion is sized based also on a coefficient of thermal expansion of the metal alloy.

4. A molding device as described in claim 2, wherein the protrusion reduces an effect of thermal expansion on the portion of the article that is aligned as substantially opposing the feature to form the substantially flat surface after the solidifying of the metal alloy.

5. A molding device as described in claim 4, wherein the protrusion is defined in the cavity such that a corresponding surface of the cavity that corresponds to the protrusion is not flat.

6. A molding device as described in claim 1, wherein the metal alloy is comprised primarily of magnesium.

7. A molding device as described in claim 1, wherein the thickness of the area proximal to the feature is less than one millimeter and the thickness of the protrusion is greater than one millimeter.

8. A molding device as described in claim 7, wherein the thickness of the area is approximately 0.65 millimeter.

9. A molding device comprising:

a mold having a plurality of molding portions that define a cavity that corresponds to an article to be molded using a metal alloy that is injected into the mold, the mold defining:

a portion of the cavity that defines a feature for the article having a thickness that is greater than a thickness of an area of the article defined by the cavity that is proximal to the feature; and a protrusion for the article aligned on a side of the cavity that is opposite to a side including the feature, the protrusion being sized such that upon solidifying of the metal alloy that forms the article, the protrusion reduces an effect of thermal expansion on the side of the article that is opposite to the feature.

10. A molding device as described in claim 9, wherein the protrusion is sized as proportional to the thickness of the feature.

11. A molding device as described in claim 10, wherein the protrusion is sized based also on a coefficient of thermal expansion of the metal alloy.

12. A molding device as described in claim 10, wherein the protrusion reduces an effect of thermal expansion on the portion of the article that is aligned as substantially opposing the feature to form the substantially flat surface after the solidifying of the metal alloy.

13. A molding device as described in claim 12, wherein the protrusion is defined in the cavity such that a corresponding surface of the cavity that corresponds to the protrusion is not flat.

14. A molding device as described in claim 10, wherein the metal alloy is comprised primarily of magnesium.

15. A molding device as described in claim 10, wherein the thickness of the area proximal to the feature is less than one millimeter and the thickness of the protrusion is greater than one millimeter.

16. A molding device as described in claim 15, wherein the thickness of the area is approximately 0.65 millimeter.

17. An apparatus comprising:

an article formed using a metal alloy that is injected into a mold, the mold having a plurality of molding portions that define a cavity having:

a portion of the cavity that defines a feature for the article having a thickness that is greater than a thickness of an area of the article defined by the cavity that is proximal to the feature; and a protrusion for the article aligned on a side of the cavity that is opposite to a side including the feature, the protrusion being sized such that upon solidifying of the metal alloy that forms the article, the protrusion shrinks to form a substantially flat surface to the side that is opposite to the feature.

18. An apparatus as described in claim 17, wherein the protrusion is sized as proportional to the thickness of the feature.

19. An apparatus as described in claim 18, wherein the protrusion is sized based also on a coefficient of thermal expansion of the metal alloy.

20. An apparatus as described in claim 18, wherein the protrusion reduces an effect of thermal expansion on the portion of the article that is aligned as substantially opposing the feature to form the substantially flat surface after the solidifying of the metal alloy.

* * * * *